US008529373B2

(12) United States Patent
Nardacci et al.

(10) Patent No.: US 8,529,373 B2
(45) Date of Patent: Sep. 10, 2013

(54) GOLF BALL WITH IMPROVED FLIGHT PERFORMANCE

(75) Inventors: Nicholas M. Nardacci, Bristol, RI (US); Laurent Bissonnette, Portsmouth, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 13/229,863

(22) Filed: Sep. 12, 2011

(65) Prior Publication Data

US 2012/0088601 A1 Apr. 12, 2012

Related U.S. Application Data

(62) Division of application No. 12/235,067, filed on Sep. 22, 2008, now Pat. No. 8,016,695.

(51) Int. Cl.
*A63B 37/06* (2006.01)

(52) U.S. Cl.
USPC ..... 473/373; 473/354

(58) Field of Classification Search
USPC ..... 473/355, 373, 374, 354
See application file for complete search history.

(56) References Cited

U.S. PATENT DOCUMENTS

| | | | | |
|---|---|---|---|---|
| 4,274,637 | A | 6/1981 | Molitor | |
| 4,729,861 | A | 3/1988 | Lynch et al. | |
| 4,925,193 | A | 5/1990 | Melvin et al. | |
| 5,249,804 | A | 10/1993 | Sanchez | |
| 5,562,552 | A | 10/1996 | Thurman | |
| 5,575,477 | A | 11/1996 | Hwang | |
| 5,682,230 | A | 10/1997 | Anfinsen et al. | |
| 5,688,191 | A | 11/1997 | Cavallaro et al. | |
| 5,713,801 | A | 2/1998 | Aoyama | |
| 5,803,831 | A | 9/1998 | Sullivan et al. | |
| 5,885,172 | A | 3/1999 | Herbert et al. | |
| 5,919,100 | A | 7/1999 | Boehm et al. | |
| 5,935,023 | A | 8/1999 | Maehara et al. | |
| 5,957,787 | A | 9/1999 | Hwang | |
| 5,965,669 | A | 10/1999 | Cavallaro et al. | |
| 5,981,654 | A | 11/1999 | Rajagopalan | |
| 5,981,658 | A | 11/1999 | Rajagopalan et al. | |
| 6,149,535 | A | 11/2000 | Bissonnette et al. | |
| 6,186,002 | B1 | 2/2001 | Lieberman et al. | |
| 6,213,898 | B1 | 4/2001 | Ogg | |
| 6,285,445 | B1 | 9/2001 | Winfield et al. | |
| 6,290,615 | B1 | 9/2001 | Ogg | |
| 6,338,684 | B1 | 1/2002 | Winfield et al. | |
| 6,797,097 | B2 | 9/2004 | Boehm et al. | |
| 7,160,954 | B2 | 1/2007 | Zieske et al. | |
| 8,016,695 | B2 * | 9/2011 | Nardacci et al. | 473/373 |
| 2001/0009310 | A1 | 7/2001 | Hebert et al. | |
| 2005/0227786 | A1 | 10/2005 | Sullivan et al. | |
| 2007/0270238 | A1 | 11/2007 | Kennedy | |
| 2010/0144464 | A1 | 6/2010 | VanDelden | |

* cited by examiner

*Primary Examiner* — Raeann Gorden
(74) *Attorney, Agent, or Firm* — Mandi B. Milbank

(57) ABSTRACT

A golf ball with aerodynamic coefficient magnitude and aerodynamic force angle, resulting in improved flight performance, such as increased carry and flight consistency regardless of ball orientation. In particular, the present invention is directed to a golf ball having increased flight distance as defined by a set of aerodynamic requirements, at particular spin ratios and Reynolds Numbers. The invention is also directed toward golf balls having high spin decay rates during the first second of flight that yields improved flight performance and longer ball flight.

17 Claims, 19 Drawing Sheets

$D_A < D_B \leq D_C \leq D_D \leq D_E$
80% $D_A$, $D_B$, $D_C$, $D_D$, $D_E$ >0.11"
DIMP. AREA > 80%

$$D_A < D_B \leq D_C \leq D_D \leq D_E$$

GOLF BALL WITH IMPROVED FLIGHT PERFORMANCE

CROSS-REFERENCE TO RELATED APPLICATIONS

This application is a divisional of U.S. patent application Ser. No. 12/235,067, filed Sep. 22, 2008, now U.S. Pat. No. 8,016,695 the entire disclosure of which is hereby incorporated herein by reference.

FIELD OF THE INVENTION

The present invention relates to a solid construction golf ball having high spin decay during the first second of flight that yields improved flight performance and longer ball flight.

BACKGROUND OF THE INVENTION

The flight of a golf ball is determined by many factors, however, the majority of the properties that determine flight are outside of the control of a golfer. While a golfer can control the speed, the launch angle, and the spin rate of a golf ball by hitting the ball with a particular club, the final resting point of the ball depends upon golf ball construction and materials, as well as environmental conditions, e.g., terrain and weather. Since flight distance and consistency are critical factors in reducing golf scores, manufacturers continually strive to make even the slightest incremental improvements in golf ball flight consistency and flight distance, e.g., one or more yards, through various aerodynamic properties and golf ball constructions. Flight consistency is a significant problem for manufacturers because many golf ball dimple patterns and/or dimple shapes that yield increased flight distances also result in asymmetric flight performance. Asymmetric flight performance prescribes that the overall flight distance is a function of ball orientation when struck with a club.

Historically, manufacturers improved flight performance via iterative testing, where golf balls with numerous dimple patterns and dimple profiles are produced and tested using mechanical drivers. Flight performance is characterized in these tests by measuring the landing position of the various ball designs. To determine if a particular ball design has desirable flight characteristics for a broad range of players, i.e., high and low swing speed players, manufacturers perform the mechanical golfer test with different ball launch conditions, which involves immense time and financial commitments. Furthermore, it is difficult to identify incremental performance improvements using these methods due to the statistical noise generated by environmental conditions, which necessitates large sample sizes for sufficient confidence intervals.

Another more precise method of determining specific dimple arrangements and dimple shapes that result in an aerodynamic advantage involves the direct measurement of aerodynamic characteristics, as opposed to ball landing positions. These aerodynamic characteristics define the forces acting upon the golf ball throughout flight.

Aerodynamic forces acting on a golf ball are typically resolved into orthogonal components of lift and drag. Lift is defined as the aerodynamic force component acting perpendicular to the flight path. It results from a difference in pressure that is created by a distortion in the air flow that results from the back spin of the ball. A boundary layer forms at the stagnation point of the ball, B, then grows and separates at points S1 and S2, as shown in FIG. 1. Due to the ball backspin, the top of the ball moves in the direction of the airflow, which retards the separation of the boundary layer. In contrast, the bottom of the ball moves against the direction of airflow, thus advancing the separation of the boundary layer at the bottom of the ball. Therefore, the position of separation of the boundary layer at the top of the ball, S1, is further back than the position of separation of the boundary layer at the bottom of the ball, S2. This asymmetrical separation creates an arch in the flow pattern, requiring the air over the top of the ball to move faster and, thus, have lower pressure than the air underneath the ball.

Drag is defined as the aerodynamic force component acting parallel to the ball flight direction. As the ball travels through the air, the air surrounding the ball has different velocities and, accordingly, different pressures. The air exerts maximum pressure at the stagnation point, B, on the front of the ball, as shown in FIG. 1. The air then flows over the sides of the ball and has increased velocity and reduced pressure. The air separates from the surface of the ball at points S1 and S2, leaving a large turbulent flow area with low pressure, i.e., the wake. The difference between the high pressure in front of the ball and the low pressure behind the ball reduces the ball speed and acts as the primary source of drag for a golf ball.

The dimples on a golf ball are used to adjust drag and lift properties of a golf ball and, therefore, a majority of golf ball manufacturers research dimple patterns, shape, volume, and cross-section in order to improve overall flight distance of a golf ball. The dimples create a thin turbulent boundary layer around the ball. The turbulence energizes the boundary layer and aids in maintaining attachment to and around the ball to reduce the area of the wake. The pressure behind the ball is increased and the drag is substantially reduced.

U.S. Pat. No. 5,935,023 discloses preferred lift and drag coefficients for a single speed with a functional dependence on spin ratio. U.S. Pat. Nos. 6,213,898 and 6,290,615 disclose golf ball dimple patterns that reduce high-speed drag and increase low speed lift. It has now been discovered, contrary to the disclosures of these patents, that reduced high-speed drag and increased low speed lift does not necessarily result in improved flight performance. For example, excessive high-speed lift or excessive low-speed drag may result in undesirable flight performance characteristics.

The art, however, is silent as to using the ball's inner construction to control the ball's aerodynamics.

SUMMARY OF THE INVENTION

The present invention is directed to a golf ball with an intermediate layer that comprises liquid to improve flight performance.

In one embodiment, the flight improvements are attained by increasing rotational drag which results in a rapid reduction in ball spin (rpm), i.e., high spin decay, during at least the first second of flight.

In a further embodiment, the golf ball achieves flight improvements by a multi-layer construction that decouples a solid central core from an outer core layer or inner cover layer to increase spin decay during at least the first second of flight.

In another embodiment, a solid construction golf ball according to the present invention comprises a solid central core, a cover layer and an intermediate layer that contains a porous support and a viscous liquid movable therewithin.

BRIEF DESCRIPTION OF THE DRAWINGS

These and other aspects of the present invention may be more fully understood with reference to, but not limited by, the following drawings.

DETAILED DESCRIPTION OF THE INVENTION

The present invention is directed to golf balls having improved aerodynamic efficiency, resulting in uniformly increased flight distance for golfers of all swing speeds. In particular, the present invention is directed to the selection of dimple arrangements and dimple profiles to obtain a unique set of aerodynamic criteria, which results in consistently improved aerodynamic efficiency. The desired aerodynamic criteria are defined by the magnitude and direction of the aerodynamic force, for the range of Spin Ratios and Reynolds Numbers that encompass the flight regime for typical golf ball trajectories. In another embodiment of the present invention, solid construction golf balls having increased flight distances are achieved by a selection of surface roughness, dimple shape, dimple distribution, and/or core constructions that increase rotational drag to increase spin decay rates during at least the first second of flight. In a further embodiment, solid construction golf balls with high spin decay during at least the first second of flight also possess the aerodynamic criteria as discussed in detail below for improved aerodynamic efficiency.

Aerodynamic Force

Figure 1:
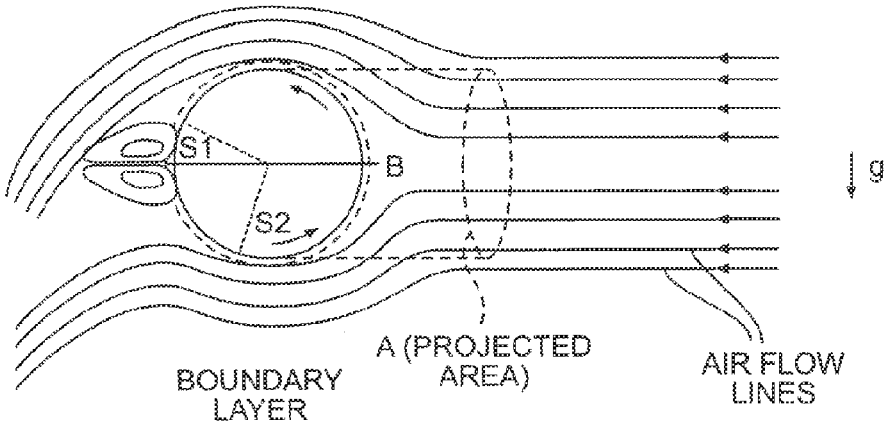
FIG. 1 is an illustration of the air flow on a golf ball in flight.
Figure 2:
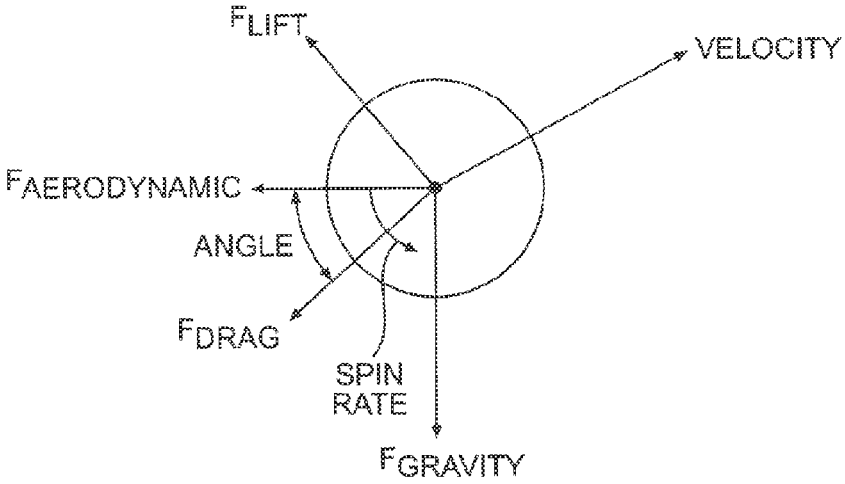
FIG. 2 is an illustration of the forces acting on a golf ball in flight.

The forces acting on a golf ball in flight are enumerated in Equation 1 and illustrated in FIG. 2:

$$1.\ F=F_L+F_D+F_G \quad \text{(Eq. 1)}$$

Where

F=total force acting on the ball $F_L$=lift force $F_D$=drag force $F_G$=gravity force The lift force ($F_L$) acts in a direction dictated by the cross product of the spin vector and the velocity vector. The drag force ($F_D$) acts in a direction that is directly opposite the velocity vector. The lift and drag forces of Equation 1 are calculated in Equations 2 and 3, respectively:

$$F_L=0.5C_L\rho AV^2 \quad \text{(Eq. 2)}$$

$$F_D=0.5C_D\rho AV^2 \quad \text{(Eq. 3)}$$

where

ρ=density of air (slugs/ft$^3$)

A=projected area of the ball (ft$^2$) ($(\pi/4)D^2$)

D=ball diameter (ft)

V=ball velocity (ft/s)

$C_L$=dimensionless lift coefficient $C_D$=dimensionless drag coefficient

Lift and drag coefficients are used to quantify the force imparted to a ball in flight and are dependent on air density, air viscosity, ball speed, and spin rate; the influence of all these parameters may be captured by two dimensionless parameters Spin Ratio (SR) and Reynolds Number ($N_{Re}$). Spin Ratio is the rotational surface speed of the ball divided by ball velocity. Reynolds Number quantifies the ratio of inertial to viscous forces acting on the golf ball moving through air. SR and $N_{Re}$ are calculated in Equations 4 and 5 below:

$$SR=\omega(D/2)/V \quad \text{(Eq. 4)}$$

$$N_{Re}=DV\rho/\mu \quad \text{(Eq. 5)}$$

where

ω=ball rotation rate (radians/s) (2π(RPS))

RPS=ball rotation rate (revolution/s)

V=ball velocity (ft/s)

D=ball diameter (ft)

ρ=air density (slugs/ft$^3$)

μ=absolute viscosity of air (lb/ft-s)

There are a number of suitable methods for determining the lift and drag coefficients for a given range of SR and $N_{Re}$, which include the use of indoor test ranges with ballistic screen technology. U.S. Pat. No. 5,682,230, the entire disclosure of which is incorporated by reference herein, teaches the use of a series of ballistic screens to acquire lift and drag coefficients. U.S. Pat. Nos. 6,186,002 and 6,285,445, also incorporated in their entirety by reference herein, disclose methods for determining lift and drag coefficients for a given range of velocities and spin rates using an indoor test range, wherein the values for $C_L$ and $C_D$ are related to SR and $N_{Re}$ for each shot. One skilled in the art of golf ball aerodynamics testing could readily determine the lift and drag coefficients through the use of an indoor test range.

The present invention is directed to a golf ball having improved flight distance as defined by two novel parameters that account for both lift and drag simultaneously: 1) the magnitude of aerodynamic force ($C_{mag}$); and 2) the direction of the aerodynamic force (Angle). It has now been discovered that flight performance improvements are attained when the dimple pattern and dimple profiles are selected to satisfy specific magnitude and direction criteria. The magnitude and angle of the aerodynamic force are linearly related to the lift and drag coefficients and, therefore, the magnitude and angle of the aerodynamic coefficients are used to establish the preferred criteria. The magnitude and the angle of the aerodynamic coefficients are defined in Equations 6 and 7 below:

$$C_{mag}=\sqrt{(C_L^2+C_D^2)} \quad \text{(Eq. 6)}$$

$$\text{Angle}=\tan^{-1}(C_L/C_D) \quad \text{(Eq. 7)}$$

Table 1 illustrates the aerodynamic criteria for a golf ball of the present invention that results in increased flight distances. The criteria are specified as low, median, and high $C_{mag}$ and Angle for eight specific combinations of SR and $N_{Re}$. Golf balls with $C_{mag}$ and Angle values between the low and the high number are preferred. More preferably, the golf balls of the invention have $C_{mag}$ and Angle values between the low and the median numbers delineated in Table 1. The $C_{mag}$ values delineated in Table 1 are intended for golf balls that conform to USGA size and weight regulations. The size and weight of the golf balls used with the aerodynamic criteria of Table 1 are 1.68 inches and 1.62 ounces, respectively.

TABLE 1

AERODYNAMIC CHARACTERISTICS
BALL DIAMETER = 1.68 INCHES, BALL WEIGHT = 1.62 OUNCES

| | | Magnitude[1] | | | Angle[2] (0) | | |
|---|---|---|---|---|---|---|---|
| $N_{Re}$ | SR | Low | Median | High | Low | Median | High |
| 230000 | 0.085 | 0.24 | 0.265 | 0.27 | 31 | 33 | 35 |
| 207000 | 0.095 | 0.25 | 0.271 | 0.28 | 34 | 36 | 38 |
| 184000 | 0.106 | 0.26 | 0.280 | 0.29 | 35 | 38 | 39 |
| 161000 | 0.122 | 0.27 | 0.291 | 0.30 | 37 | 40 | 42 |
| 138000 | 0.142 | 0.29 | 0.311 | 0.32 | 38 | 41 | 43 |
| 115000 | 0.170 | 0.32 | 0.344 | 0.35 | 40 | 42 | 44 |
| 92000 | 0.213 | 0.36 | 0.390 | 0.40 | 41 | 43 | 45 |
| 69000 | 0.284 | 0.40 | 0.440 | 0.45 | 40 | 42 | 44 |

[1]As defined by Eq. 6
[2]As defined by Eq. 7

To ensure consistent flight performance regardless of ball orientation, the percent deviation of $C_{mag}$ for each of the SR and $N_{Re}$ combinations listed in Table 1 plays an important role. The percent deviation of $C_{mag}$ may be calculated in accordance with Equation 8, wherein the ratio of the absolute value of the difference between the $C_{mag}$ for two orientations to the average of the $C_{mag}$ for the two orientations is multiplied by 100.

$$\text{Percent deviation } C_{mag}=|(C_{mag1}-C_{mag2})|/((C_{mag1}+C_{mag2})/*100 \quad \text{(Eq. 8)}$$

where $C_{mag1}=C_{mag}$ for orientation 1
$C_{mag2}=C_{mag}$ for orientation 2

In one embodiment, the percent deviation is about 6 percent or less. In another embodiment, the deviation of $C_{mag}$ is about 3 percent or less. To achieve the consistent flight performance, the percent deviation criteria of Equation 8 is preferably satisfied for each of the eight $C_{mag}$ values associated with the eight SR and $N_{Re}$ values contained in Table 1.

Aerodynamic asymmetry typically arises from parting lines inherent in the dimple arrangement or from parting lines associated with the manufacturing process. The percent $C_{mag}$ deviation should be obtained using $C_{mag}$ values measured with the axis of rotation normal to the parting line, commonly referred to as a poles horizontal, PH, orientation and $C_{mag}$ values measured in an orientation orthogonal to PH, commonly referred to as a pole over pole, PP orientation. The maximum aerodynamic asymmetry is generally measured between the PP and PH orientation.

One of ordinary skill in the art would be aware, however, that the percent deviation of $C_{mag}$ as outlined above applies to PH and PP, as well as any other two orientations. For example, if a particular dimple pattern is used having a great circle of shallow dimples, which will be described in greater detail below, different orientations should be measured. The axis of rotation to be used for measurement of symmetry in the above example scenario would be normal to the plane described by the great circle and coincident to the plane of the great circle.

It has also been discovered that the $C_{mag}$ and Angle criteria delineated in Table 1 for golf balls with a nominal diameter of 1.68 and a nominal weight of 1.62 ounces may be advantageously scaled to obtain the similar optimized criteria for golf balls of any size and weight. The aerodynamic criteria of Table 1 may be adjusted to obtain the $C_{mag}$ and angle for golf balls of any size and weight in accordance with Equations 9 and 10.

$$C_{mag(ball)}=C_{mag(Table\ 1)}\sqrt{((\sin(\text{Angle}_{(Table1)})*(W_{ball}/1.62)*(1.68/D_{ball})^2)^2+(\cos(\text{Angle}_{(Table1)})^2)} \quad \text{(Eq. 9)}$$

$$\text{Angle}_{(ball)}=\tan^{-1}(\tan(\text{Angle}_{(Table\ 1)})*(W_{ball}/1.62)*(1.68/D_{ball})^2) \quad \text{(Eq. 10)}$$

For example, Table 2 illustrates aerodynamic criteria for balls with a diameter of 1.60 inches and a weight of 1.7 ounces as calculated using Table 1, ball diameter, ball weight, and Equations 9 and 10.

TABLE 2

AERODYNAMIC CHARACTERISTICS
BALL DIAMETER = 1.60 INCHES, BALL WEIGHT = 1.70 OUNCES

| | | Magnitude[1] | | | Angle[2] (0) | | |
|---|---|---|---|---|---|---|---|
| $N_{Re}$ | SR | Low | Median | High | Low | Median | High |
| 230000 | 0.085 | 0.24 | 0.265 | 0.27 | 31 | 33 | 35 |
| 207000 | 0.095 | 0.262 | 0.287 | 0.297 | 38 | 40 | 42 |
| 184000 | 0.106 | 0.271 | 0.297 | 0.308 | 39 | 42 | 44 |
| 161000 | 0.122 | 0.83 | 0.311 | 0.322 | 42 | 44 | 46 |
| 138000 | 0.142 | 0.304 | 0.333 | 0.346 | 43 | 45 | 47 |
| 115000 | 0.170 | 0.337 | 0.370 | 0.383 | 44 | 46 | 49 |
| 92000 | 0.213 | 0.382 | 0.420 | 0.435 | 45 | 47 | 50 |
| 69000 | 0.284 | 0.430 | 0.473 | 0.489 | 44 | 47 | 49 |

[1]As defined by Eq. 9
[2]As defined by Eq. 10

Table 3 shows lift and drag coefficients ($C_L$, $C_D$), as well as $C_{mag}$ and Angle, for a golf ball having a nominal diameter of 1.68 inches and a nominal weight of 1.61 ounces, with an icosahedron pattern with 392 dimples and two dimple diameters, of which the dimple pattern will be described in more detail below. The percent deviation in $C_{mag}$ for PP and PH ball orientations are also shown over the range of $N_{Re}$ and SR. The deviation in $C_{mag}$ for the two orientations over the entire range is less than about 3 percent.

TABLE 3

AERODYNAMIC CHARACTERISTICS
BALL DIAMETER = 1.68 INCHES, BALL WEIGHT = 1.61 OUNCES

| | | PP Orientation | | | | PH Orientation | | | | % Dev |
|---|---|---|---|---|---|---|---|---|---|---|
| $N_{Re}$ | SR | $C_L$ | $C_D$ | $C_{mag}$[1] | Angle[2] | $C_L$ | $C_D$ | $C_{mag}$[1] | Angle[2] | $C_{mag}$ |
| 230000 | 0.085 | 0.144 | 0.219 | 0.262 | 33.4 | 0.138 | 0.217 | 0.257 | 32.6 | 1.9 |
| 207000 | 0.095 | 0.159 | 0.216 | 0.268 | 36.3 | 0.154 | 0.214 | 0.264 | 35.7 | 1.8 |
| 184000 | 0.106 | 0.169 | 0.220 | 0.277 | 37.5 | 0.166 | 0.216 | 0.272 | 37.5 | 1.8 |
| 161000 | 0.122 | 0.185 | 0.221 | 0.288 | 39.8 | 0.181 | 0.221 | 0.286 | 39.4 | 0.9 |
| 138000 | 0.142 | 0.202 | 0.232 | 0.308 | 41.1 | 0.199 | 0.233 | 0.306 | 40.5 | 0.5 |
| 115000 | 0.170 | 0.229 | 0.252 | 0.341 | 42.2 | 0.228 | 0.252 | 0.340 | 42.2 | 0.2 |
| 92000 | 0.213 | 0.264 | 0.281 | 0.386 | 43.2 | 0.270 | 0.285 | 0.393 | 43.5 | 1.8 |
| 69000 | 0.284 | 0.278 | 0.305 | 0.413 | 42.3 | 0.290 | 0.309 | 0.423 | 43.2 | 2.5 |
| | | | SUM | 2.543 | | | SUM | 2.541 | | |

[1]As defined by Eq. 9
[2]As defined by Eq. 10

Table 4 shows lift and drag coefficients ($C_L$, $C_D$), as well as $C_{mag}$ and Angle for a prior golf ball having a nominal diameter of 1.68 inches and a nominal weight of 1.61 ounces. The percent deviation in $C_{mag}$ for PP and PH ball orientations are also shown over the range of $N_{Re}$ and SR. The deviation in $C_{mag}$ for the two orientations is greater than about 3 percent over the entire range, greater than about 6 percent for $N_{Re}$ of 161000, 138000, 115000, and 92000, and exceeds 10 percent at a $N_{Re}$ of 69000.

TABLE 4

AERODYNAMIC CHARACTERISTICS FOR PRIOR ART GOLF BALL
BALL DIAMETER = 1.68 INCHES, BALL WEIGHT = 1.61 OUNCES

| | | PP Orientation | | | | PH Orientation | | | | % Dev |
|---|---|---|---|---|---|---|---|---|---|---|
| $N_{Re}$ | SR | $C_L$ | $C_D$ | $C_{mag}$[1] | Angle[2] | $C_L$ | $C_D$ | $C_{mag}$[1] | Angle[2] | $C_{mag}$ |
| 230000 | 0.085 | 0.151 | 0.222 | 0.269 | 34.3 | 0.138 | 0.219 | 0.259 | 32.3 | 3.6 |
| 207000 | 0.095 | 0.160 | 0.223 | 0.274 | 35.6 | 0.145 | 0.219 | 0.263 | 33.4 | 4.1 |
| 184000 | 0.106 | 0.172 | 0.227 | 0.285 | 37.2 | 0.154 | 0.221 | 0.269 | 34.8 | 5.6 |
| 161000 | 0.122 | 0.188 | 0.233 | 0.299 | 38.9 | 0.166 | 0.225 | 0.279 | 36.5 | 6.9 |
| 138000 | 0.142 | 0.209 | 0.245 | 0.322 | 40.5 | 0.184 | 0.231 | 0.295 | 38.5 | 8.7 |
| 115000 | 0.170 | 0.242 | 0.269 | 0.361 | 42.0 | 0.213 | 0.249 | 0.328 | 40.5 | 9.7 |
| 92000 | 0.213 | 0.280 | 0.309 | 0.417 | 42.2 | 0.253 | 0.283 | 0.380 | 41.8 | 9.5 |
| 69000 | 0.284 | 0.270 | 0.308 | 0.409 | 41.2 | 0.308 | 0.337 | 0.457 | 42.5 | 10.9 |
| | | | SUM | 2.637 | | | SUM | 2.531 | | |

[1]As defined by Eq. 9
[2]As defined by Eq. 10

Table 5 illustrates the flight performance of a golf ball of the present invention having a nominal diameter of 1.68 inches and weight of 1.61 ounces, compared to a prior art golf ball having similar diameter and weight. Each prior art ball is compared to a golf ball of the present invention at the same speed, angle, and back spin.

TABLE 5

BALL FLIGHT PERFORMANCE, INVENTION VS. PRIOR ART GOLF BALL
BALL DIAMETER = 1.68 INCHES, BALL WEIGHT = 1.61 OUNCES

| | | Ball | | | | | |
|---|---|---|---|---|---|---|---|
| | | Launch Conditions | | | Ball Flight | | |
| | Ball Orientation | Speed (mph) | Angle | Rotation Rate (rpm) | Distance (yds) | Time (s) | Impact Angle |
| Prior Art | PP | 168.4 | 8.0 | 3500 | 267.2 | 7.06 | 41.4 |
| | PH | 168.4 | 8.0 | 3500 | 271.0 | 6.77 | 36.2 |
| Invention | PP | 168.4 | 8.0 | 3500 | 276.7 | 7.14 | 39.9 |
| | PH | 168.4 | 8.0 | 3500 | 277.6 | 7.14 | 39.2 |

TABLE 5-continued

BALL FLIGHT PERFORMANCE, INVENTION VS. PRIOR ART GOLF BALL
BALL DIAMETER = 1.68 INCHES, BALL WEIGHT = 1.61 OUNCES

| | | Ball | | | | | |
|---|---|---|---|---|---|---|---|
| | | Launch Conditions | | | Ball Flight | | |
| | Ball Orientation | Speed (mph) | Angle | Rotation Rate (rpm) | Distance (yds) | Time (s) | Impact Angle |
| Prior Art | PP | 145.4 | 8.0 | 3000 | 220.8 | 5.59 | 31.3 |
| | PH | 145.4 | 8.0 | 3000 | 216.9 | 5.18 | 25.4 |
| Invention | PP | 145.4 | 8.0 | 3000 | 226.5 | 5.61 | 29.3 |
| | PH | 145.4 | 8.0 | 3000 | 226.5 | 5.60 | 28.7 |

Table 5 shows an improvement in flight distance for a golf ball of the present invention of between about 6 to about 10 yards over a similar size and weight prior art golf ball. Table 5 also shows that the flight distance of prior art golf balls is dependent on the orientation when struck, i.e., a deviation between a PP and PH orientation results in about 4 yards distance between the two orientations. In contrast, golf balls of the present invention exhibit less than about 1 yard variation in flight distance due to orientation. Additionally, prior art golf balls exhibit large variations in the angle of ball impact with the ground at the end of flight, i.e., about 5°, for the two orientations, while golf balls of the present invention have a variation in impact angles for the two orientations of less than about 1°. A large variation in impact angle typically leads to significantly different amounts of roll when the ball strikes the ground.

Figure 3:
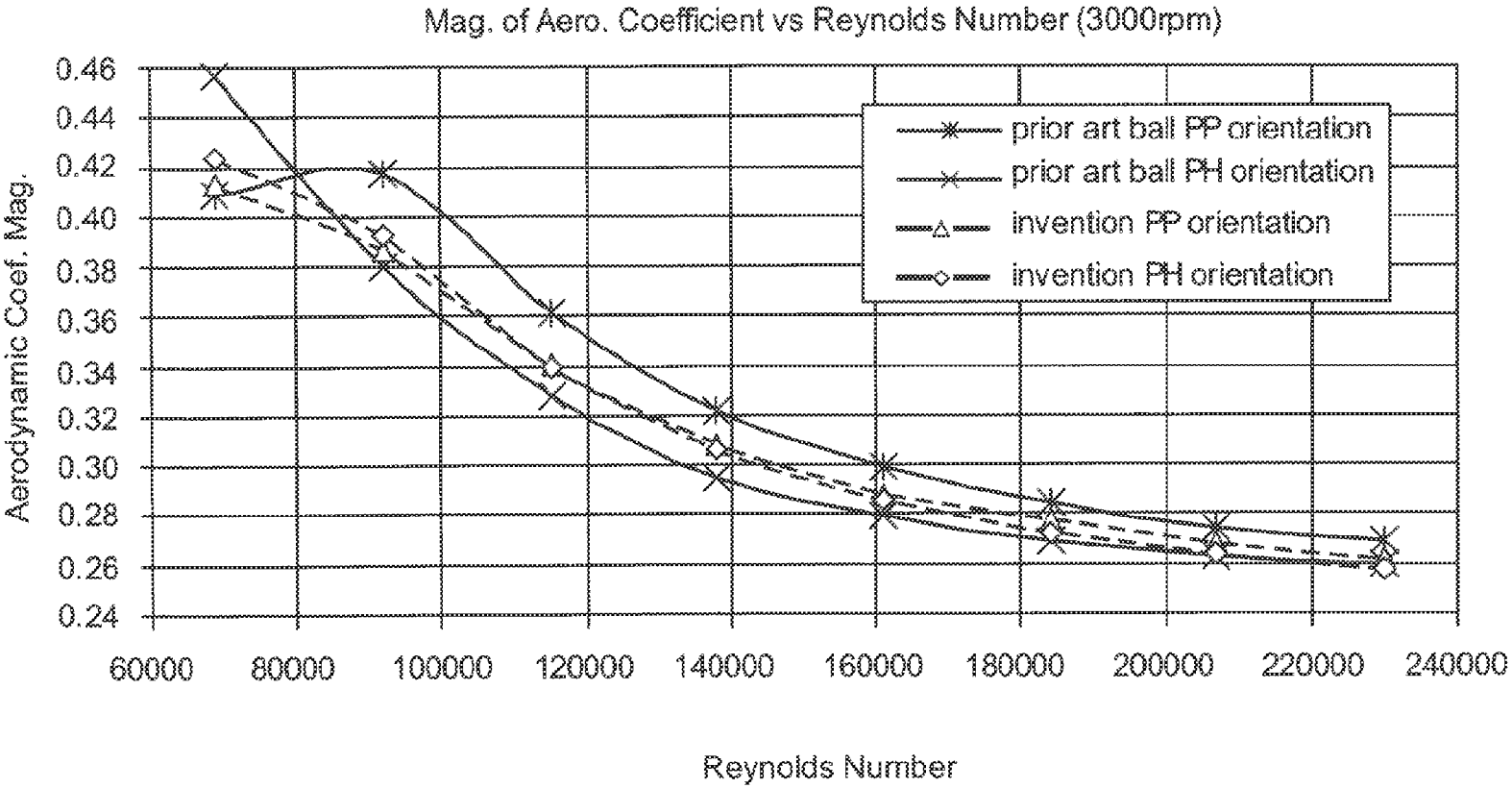
FIG. 3 is a graph of the magnitude of aerodynamic coefficients versus Reynolds Number for a golf ball made according to the present invention and a prior art golf ball.
Figure 4:
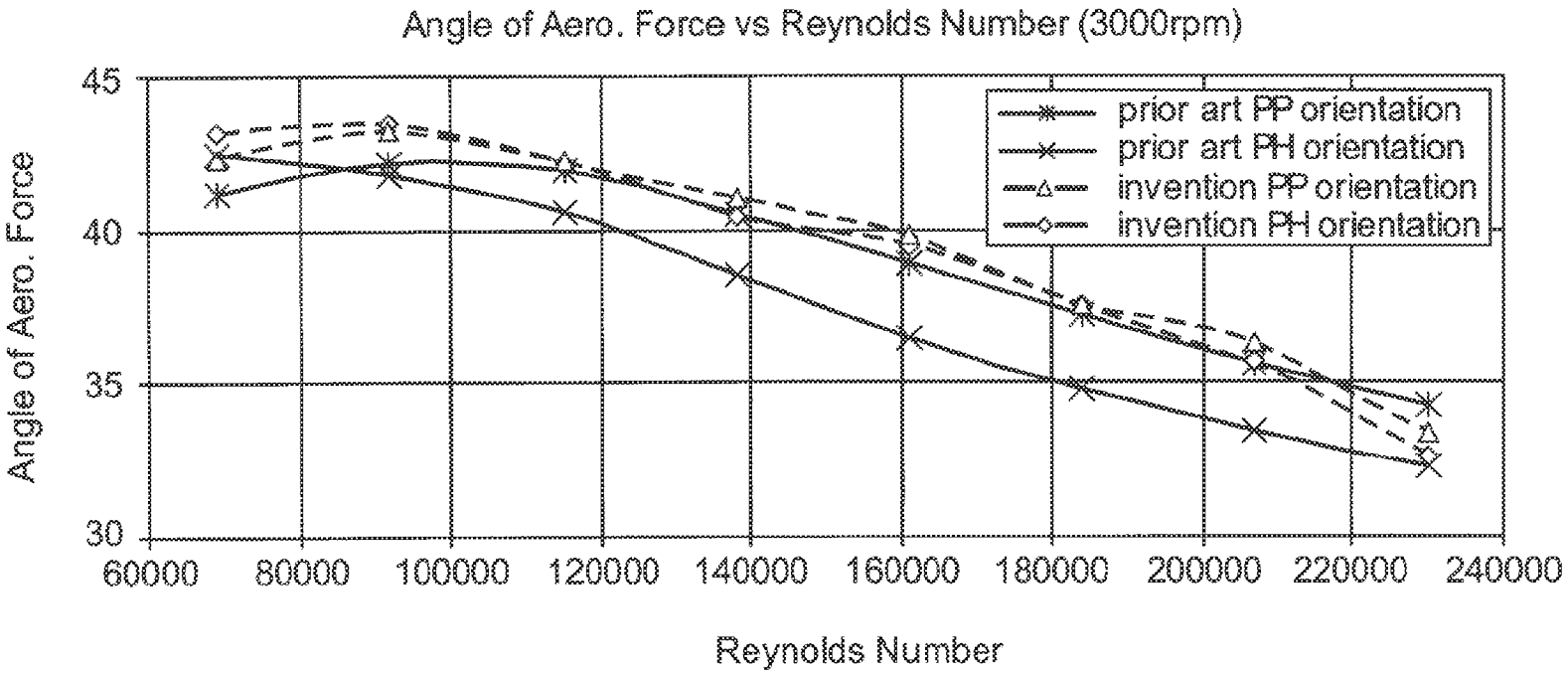
FIG. 4 is a graph of the angle of aerodynamic force versus Reynolds Number for a golf ball made according to the present invention and a prior art golf ball.

The advantageously consistent flight performance of a golf ball of the present invention, i.e., the less variation in flight distance and impact angle, results in more accurate play and potentially yields lower golf scores. FIGS. 3 and 4 illustrate the magnitude of the aerodynamic coefficients and the angle of aerodynamic force plotted versus $N_{Re}$ for a golf ball of the present invention and a prior art golf ball, each having a diameter of about 1.68 inches and a weight of about 1.61 ounces with a fixed spin rate of 3000 rpm. As shown in FIG. 3, the magnitude of the aerodynamic coefficient is substantially lower and more consistent between orientations for a golf ball of the present invention as compared to a prior art golf ball throughout A variety of golf ball sizes and weights, constructions, including dimple patterns and profiles, and materials are contemplated to fit the aerodynamic characteristics as outlined in Table 1, and as modified for different sizes and weights in accordance with Equations 9 and 10. Several non-limiting examples follow.

Spin Decay

The rotational decay rate of a golf ball in flight is influenced by a variety of factors including: core constructions, surface roughness, dimple shape, and/or dimple distribution. Through numerical analysis and performance testing, it has been discovered that solid construction golf balls in accordance with an embodiment of the present invention having high spin decay rates during at least the first second of flight yield improved flight performance over prior art solid construction golf balls. With reference to Table 6, a solid construction golf ball according to the present invention having a high spin decay rate in the first second of flight was shown to have greater carry and total distance than a prior art solid construction golf ball having low spin decay in the first second of flight. As used herein, a high spin decay golf ball is one in which a spin rate (rpm) of the ball after the first second of flight is decreased by greater than about 4% over an initial spin rate (rpm) of the golf ball at launch. As used herein, a low spin decay golf ball is one in which a spin rate (rpm) of the ball after the first second of flight is decreased by less than about 4% over an initial spin rate (rpm) of the golf ball at launch. Table 6 illustrates the total distance improvements.

TABLE 6A

EFFECT OF SPIN DECAY ON BALL FLIGHT PERFORMANCE
INVENTION VS. PRIOR ART GOLF BALL
BALL DIAMETER = 1.68 INCHES, BALL WEIGHT = 1.62 OUNCES

| Launch Conditions | | | Ball Flight | | | | | | | |
|---|---|---|---|---|---|---|---|---|---|---|
| | | | | | | Max | | Speed @ | | Spin Rate @ |
| Speed (mph) | Angle | Spin Rate (rpm) | Carry (yds) | Roll (ft) | Total (yds) | Height (yds) | Flight Time (s) | Impact (mph) | Impact Angle | Impact (rpm) |
| Prior Art Solid Construction Golf Ball With Low Spin Decay | | | | | | | | | | |
| 140.00 | 14.00 | 2500 | 216.54 | 36.92 | 228.85 | 29.74 | 6.38 | 56.07 | 43.56 | 2236.69 |
| 160.00 | 13.00 | 2500 | 251.84 | 29.34 | 261.62 | 36.77 | 7.13 | 58.09 | 46.82 | 2207.69 |
| 180.00 | 12.00 | 2500 | 283.63 | 22.92 | 291.27 | 43.95 | 7.79 | 60.03 | 49.59 | 2182.17 |
| 140.00 | 14.00 | 3500 | 210.89 | 20.23 | 217.63 | 36.39 | 7.02 | 53.86 | 50.63 | 3096.70 |
| 160.00 | 13.00 | 3500 | 243.59 | 13.92 | 248.23 | 45.21 | 7.83 | 56.56 | 53.68 | 3053.15 |
| 180.00 | 12.00 | 3500 | 272.95 | 9.32 | 276.06 | 54.07 | 8.54 | 59.05 | 55.98 | 3015.45 |
| Exemplary Golf Ball With High Spin Decay of Present Invention | | | | | | | | | | |
| 140.00 | 14.00 | 2500 | 215.66 | 42.81 | 229.93 | 28.73 | 6.15 | 58.42 | 42.23 | 1627.04 |
| 160.00 | 13.00 | 2500 | 251.33 | 35.35 | 263.11 | 35.37 | 6.86 | 60.67 | 45.27 | 1549.10 |
| 180.00 | 12.00 | 2500 | 283.64 | 28.65 | 293.19 | 42.16 | 7.48 | 62.79 | 47.97 | 1483.13 |

TABLE 6A-continued

EFFECT OF SPIN DECAY ON BALL FLIGHT PERFORMANCE
INVENTION VS. PRIOR ART GOLF BALL
BALL DIAMETER = 1.68 INCHES, BALL WEIGHT = 1.62 OUNCES

| Launch Conditions | | | Ball Flight | | | | | | | |
|---|---|---|---|---|---|---|---|---|---|---|
| | | | | | | Max | | Speed @ | | Spin Rate @ |
| Speed (mph) | Angle | Spin Rate (rpm) | Carry (yds) | Roll (ft) | Total (yds) | Height (yds) | Flight Time (s) | Impact (mph) | Impact Angle | Impact (rpm) |
| 140.00 | 14.00 | 3500 | 211.63 | 26.08 | 220.32 | 35.31 | 6.78 | 56.23 | 49.82 | 2179.99 |
| 160.00 | 13.00 | 3500 | 245.18 | 19.27 | 251.61 | 43.65 | 7.54 | 59.16 | 52.89 | 2067.08 |
| 180.00 | 12.00 | 3500 | 275.43 | 13.89 | 280.06 | 52.05 | 8.21 | 61.87 | 55.32 | 1973.08 |

Figure 22:
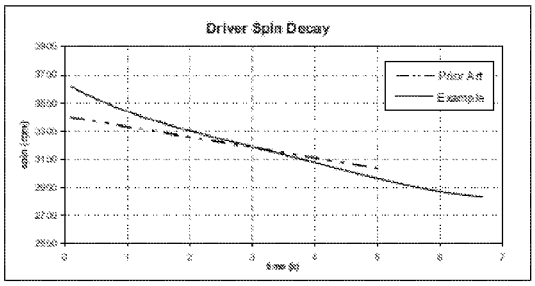
FIGS. 22-24 are graphic illustrations of the spin decay of a Pro V1x® golf ball in comparison with exemplary spin decay in accordance with the present invention.
Figure 23:
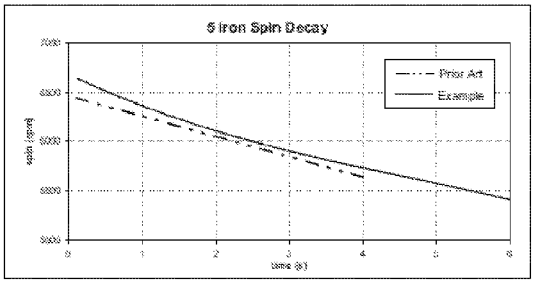
Figure 24:
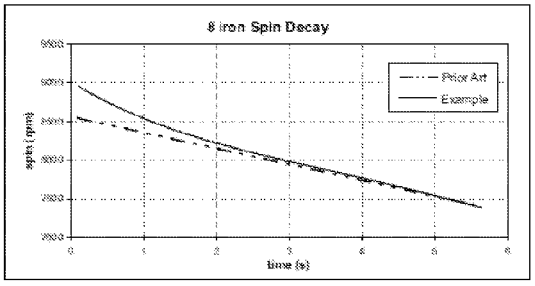

Spin decay rates may be determined using a Trackman launch monitor available from ISG Company of Copenhagen, Denmark which measures spin rates throughout the flight of a golf ball. FIGS. 22-24 illustrate spin decay results measured during the flight of a conventional golf ball, i.e., Pro V1X®, in comparison with the exemplary expected spin decay of a golf ball having a solid core, an intermediate layer comprised of at least a viscous fluid, and solid outer cover, made in accordance with the present invention. As shown, a golf ball in accordance with the present invention is expected to start off with a higher spin rate at impact but its spin rate will decline more rapidly in the first second of flight than the conventional golf ball. After about two seconds, as each of FIGS. 22-24 shows, the spin rate and spin decay rate over the remainder of the flight of the two balls becomes substantially equal.

Table 6B is based on the data collected from each of FIGS. 22-24. Table 6B shows that the exemplary spin decay rate in the first second of flight for a solid construction golf ball having a solid core, at least an intermediate viscous fluid layer, and a solid outer cover in accordance with the present invention is greater than the conventional ball regardless of the club used. Further, the anticipated spin decay over five seconds of flight is also greater for the solid construction golf ball in accordance with the present invention even though the two balls essentially have the same trajectory from two seconds of flight on as shown in FIGS. 22-24. This result is attributable to the higher initial spin rate of the golf ball in accordance with the present invention as compared to the Pro V1x® ball.

TABLE 6B

SPIN DECAY OVER FLIGHT OF PRO V1X ® GOLF BALL
VS. ANTICIPATED SPIN DECAY OVER FLIGHT OF SOLID
CONSTRUCTION GOLF BALL OF PRESENT INVENTION

| | Club | | | | | | | | |
|---|---|---|---|---|---|---|---|---|---|
| | Driver | | | 5 Iron | | | 8 Iron | | |
| | 1 sec | 3 sec | 5 sec | 1 sec | 3 sec | 5 sec | 1 sec | 3 sec | 5 sec |
| Pro V1x ® Spin Decay | 3.1% | 8.8% | 12.8% | 3.4% | 9.7% | 15.5% | 3.6% | 9.0% | 13.3% |
| Anticipated Spin Decay | 6.2% | 15.8% | 21.3% | 4.8% | 12.0% | 16.6% | 5.4% | 8.7% | 17.2% |

FIGS. 22-24 and Table 6B demonstrate that the conventional solid construction golf ball yields spin decay rates of less than 4% for the first second of flight.

In a further embodiment, golf balls having high spin decay according to the present invention would also have lift and drag coefficients that provide the desired aerodynamic characteristics of Table 1 to achieve longer flight distances, as well as consistent flight performance.

Dimple Patterns

One way of adjusting the magnitude of aerodynamic coefficients and angle of aerodynamic force for a ball to satisfy the aerodynamic criteria of Table 1 is through different dimple patterns and profiles. As used herein, the term "dimple", may include any texturizing on the surface of a golf ball, e.g., depressions and extrusions. Some non-limiting examples of depressions and extrusions include, but are not limited to, spherical depressions, meshes, raised ridges, and brambles. The depressions and extrusions may take a variety of planform shapes, such as circular, polygonal, oval, or irregular. Dimples that have multi-level configurations, i.e., dimple within a dimple, are also contemplated by the invention to obtain desirable aerodynamic characteristics.

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment of the present invention, the dimple pattern is at least partially defined by phyllotaxis-based patterns, such as those described U.S. Pat. No. 6,338,684, which is incorporated by reference in its entirety. In one embodiment, a dimple pattern that provides greater than about 50 percent surface coverage is selected. In another embodiment, the dimple pattern provides greater than about 70 percent surface coverage, and more preferably, the dimple surface coverage is greater than 80 percent.

Several additional non-limiting examples follow of different dimple pattern geometries that may be used to obtain the aerodynamic criteria of Table 1.

Figure 5:
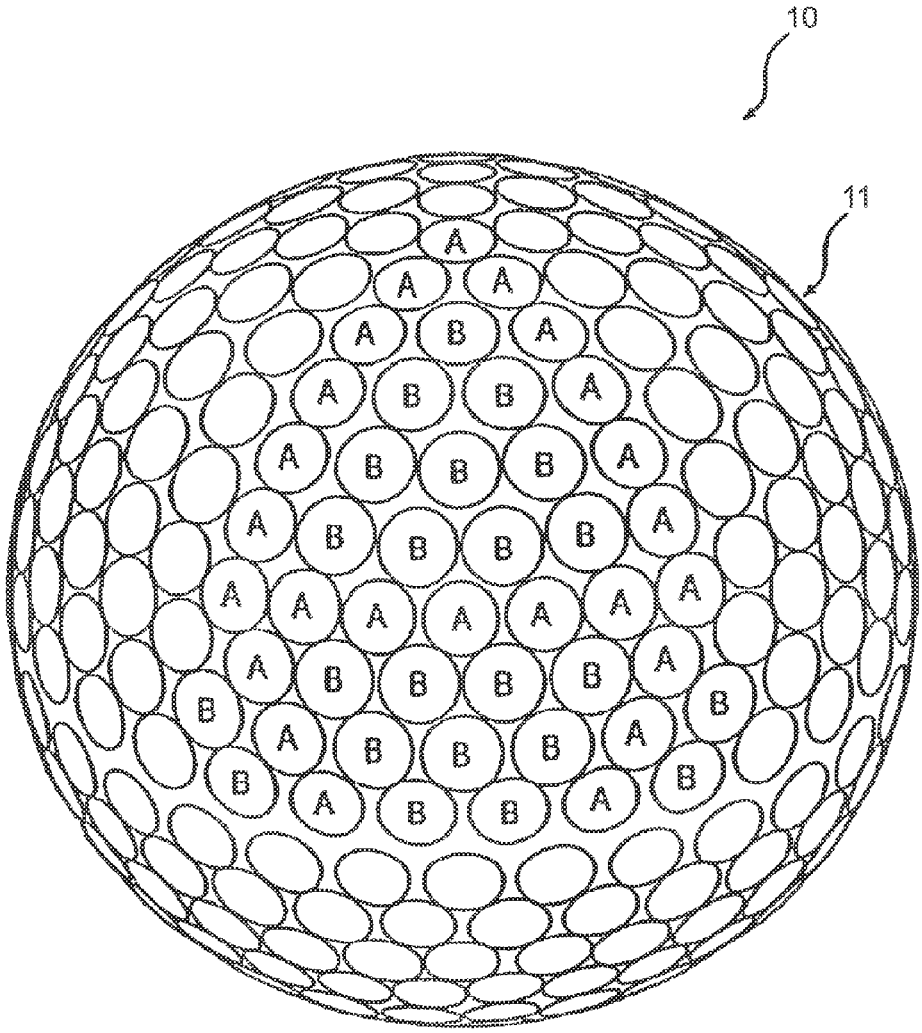
FIG. 5 PRIOR ART
FIG. 5 is an isometric view of the icosahedron pattern used on the prior art TITLEIST PROFESSIONAL ball showing dimple sizes.
Figure 6:
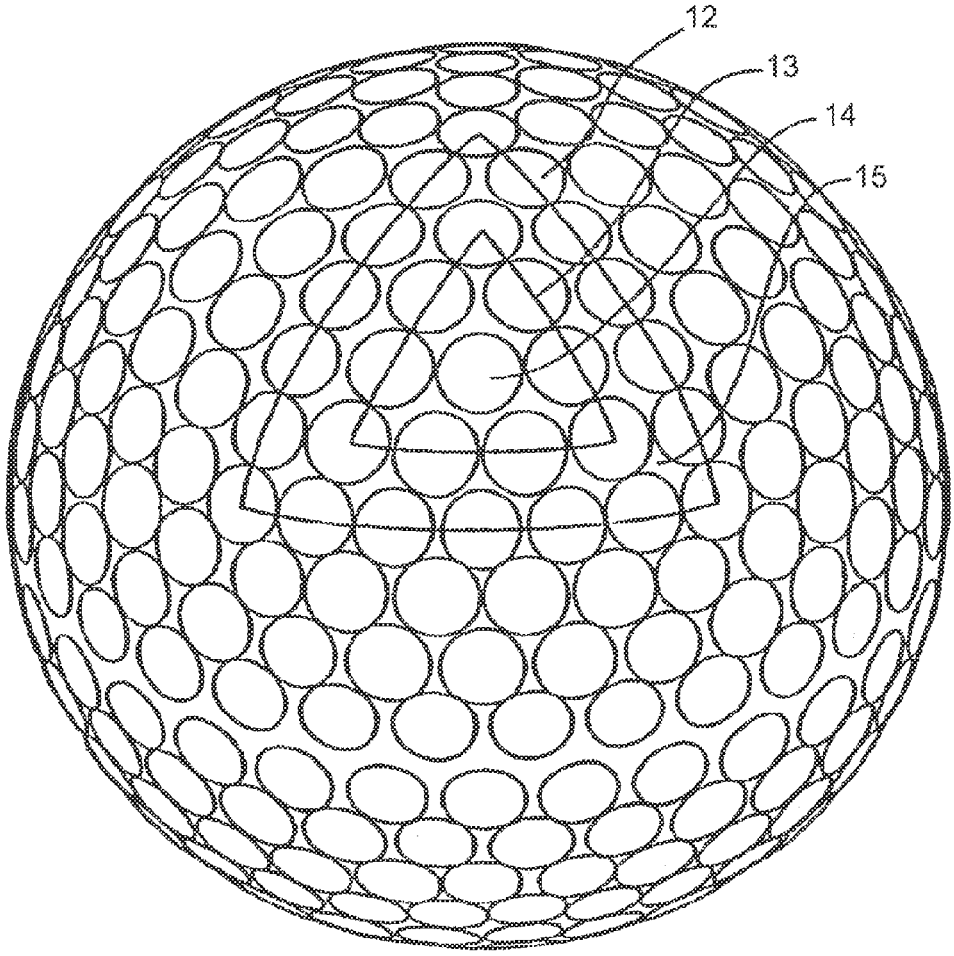
FIG. 6 PRIOR ART
FIG. 6 is an isometric view of the icosahedron pattern used on the prior art TITLEIST PROFESSIONAL ball showing the triangular regions formed by the icosahedron pattern.

FIGS. 5 and 6 show the TITLEIST PROFESSIONAL golf ball 10 with a plurality of dimples 11 on the outer surface that are formed into a dimple pattern having two sizes of dimples. The first set of dimples A have diameters of about 0.14 inches and form the outer triangle 12 of the icosahedron dimple pattern. The second set of dimples B have diameters of about 0.16 inches and form the inner triangle 13 and the center dimple 14. The dimples 11 cover less than 80 percent of the outer surface of the golf ball and there are a significant number of large spaces 15 between adjacent dimples, i.e., spaces that could hold a dimple of 0.03 inches diameter or greater.

Figure 7:
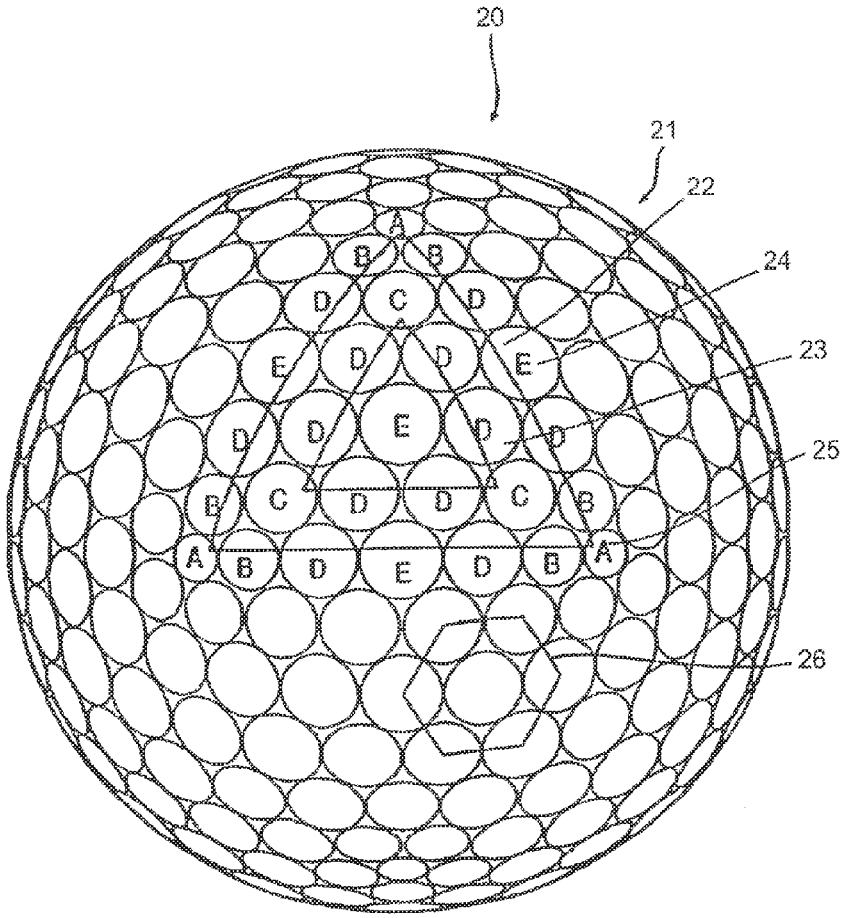
FIG. 7 is an isometric view of a first embodiment of a golf ball according to the present invention having an icosahedron pattern, showing dimple sizes.
Figure 8:
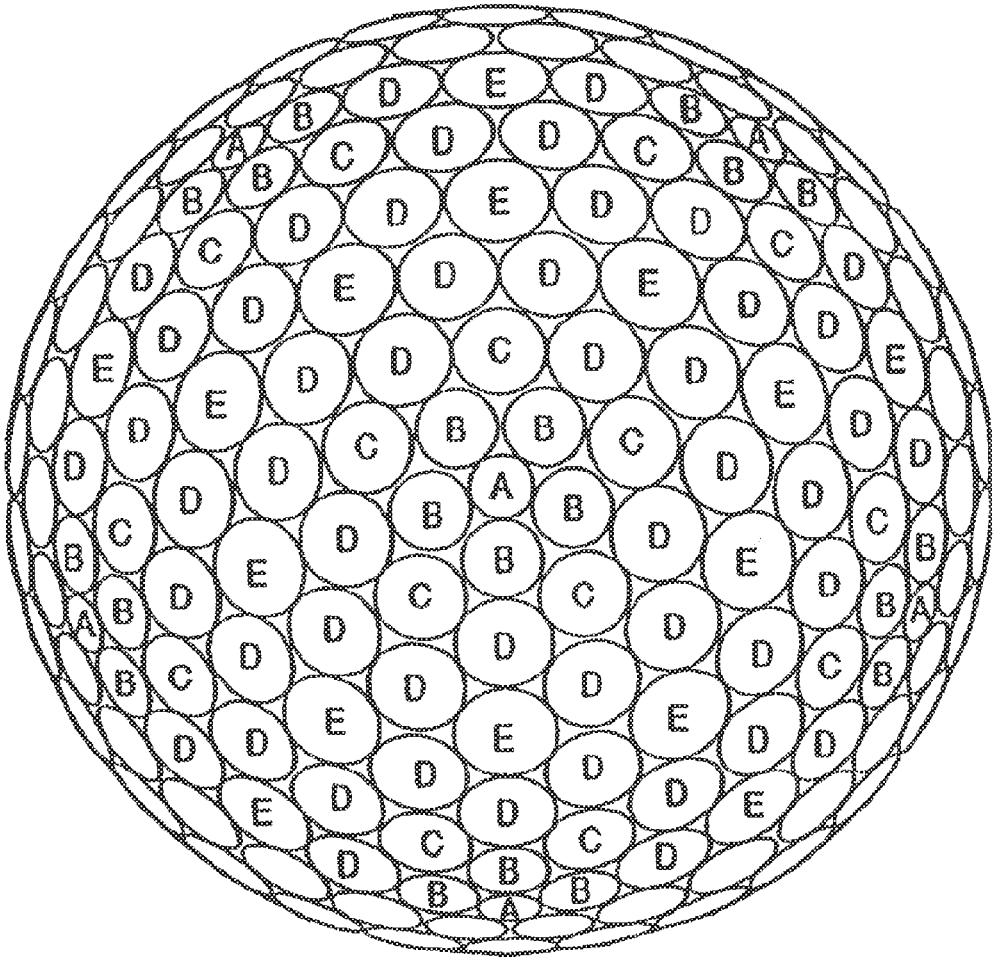
FIG. 8 is a top view of the golf ball in FIG. 7, showing dimple sizes and arrangement.
Figure 9:
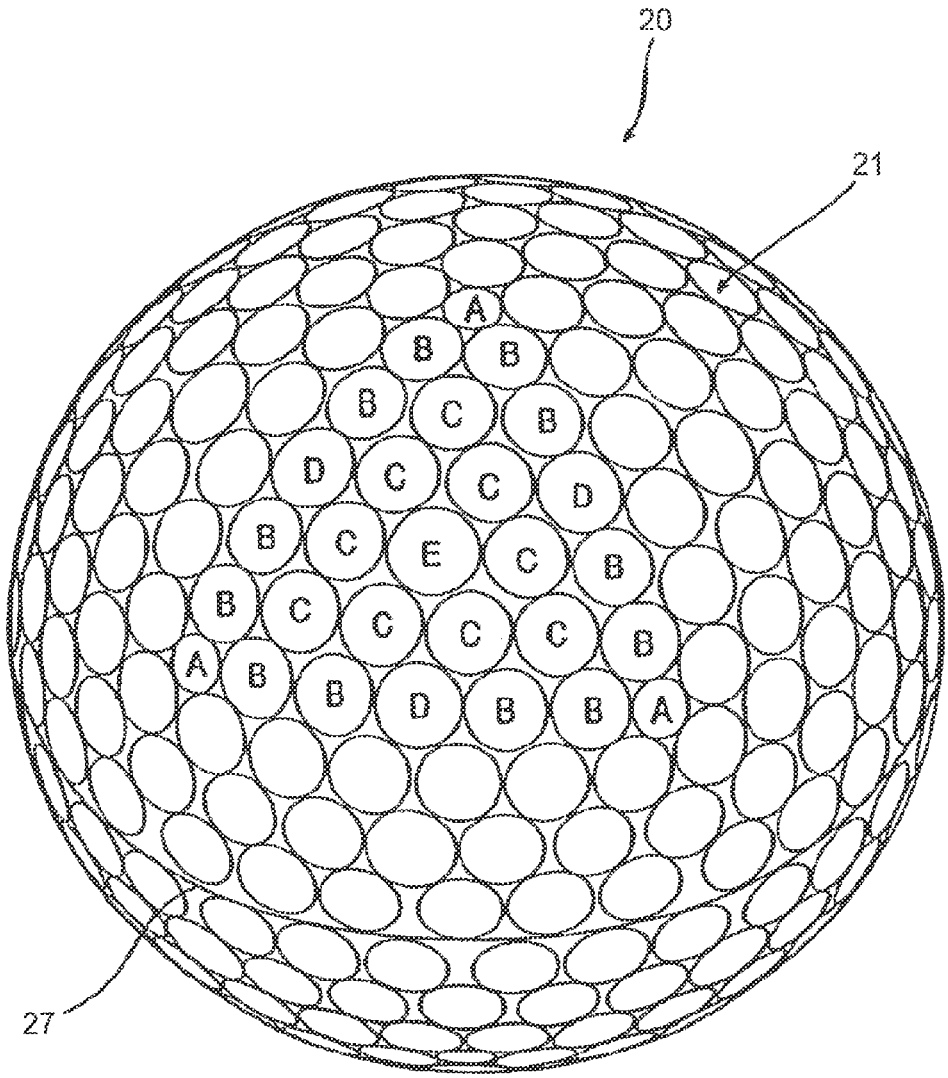
FIG. 9 is an isometric view of a second embodiment of a golf ball according to the present invention having an icosahedron pattern, showing dimple sizes and the triangular regions formed from the icosahedron pattern.
Figure 10:
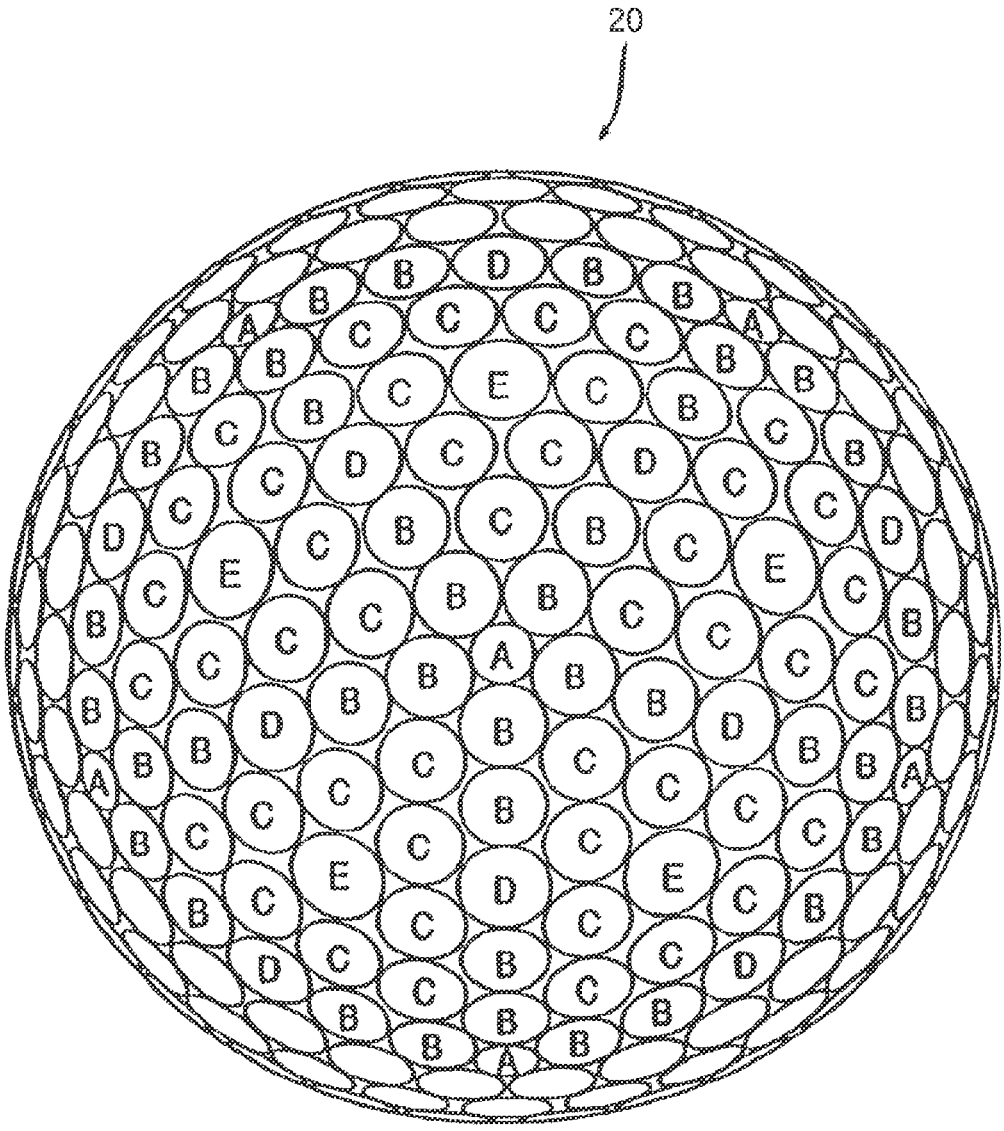
FIG. 10 is a top view of the golf ball in FIG. 9, showing dimple sizes and arrangement.

FIGS. 7 and 8 show a golf ball 20 according to the first dimple pattern embodiment of the present invention with a plurality of dimples 21 in an icosahedron pattern. In an icosahedron pattern, there are twenty triangular regions that are generally formed from the dimples. The icosahedron pattern has five triangles formed at both the top and bottom of the ball, each of which shares the pole dimple as a point. There are also ten triangles that extend around the middle of the ball.

In this first dimple pattern embodiment, there are five different sized dimples A-E, wherein dimples E ($D_E$) are greater than dimples D ($D_D$), which are greater than dimples C ($D_C$), which are greater than dimples B($D_B$), which are greater than dimples A ($D_A$); $D_E>D_D>D_C>D_B>D_A$. Dimple minimum sizes according to this embodiment are set forth in Table 7 below:

TABLE 7

DIMPLE SIZES FOR FIRST DIMPLE PATTERN EMBODIMENT

| Dimple | Percent of Ball Diameter |
|---|---|
| A | 6.55 |
| B | 8.33 |
| C | 9.52 |
| D | 10.12 |
| E | 10.71 |

The dimples of this embodiment are formed in large triangles 22 and small triangles 23. The dimples along the sides of the large triangle 22 increase in diameter toward the midpoint 24 of the sides. The largest dimple along the sides, $D_E$, is located at the midpoint 24 of each side of the large triangle 22, and the smallest dimples, $D_A$, are located at the triangle points 25. In this embodiment, each dimple along the sides is larger than the adjacent dimple toward the triangle point.

FIGS. 9-12 illustrate a second dimple pattern embodiment contemplated for the golf ball of the present invention. In this embodiment, there are again five different sized dimples A-E, wherein dimples E ($D_E$) are greater than dimples D ($D_D$), which are greater than dimples C ($D_C$), which are greater than dimples B($D_B$), which are greater than dimples A ($D_A$); $D_E>D_D>D_C>D_B>D_A$. Dimple minimum sizes according to this embodiment are set forth in Table 8 below:

TABLE 8

DIMPLE SIZES FOR SECOND DIMPLE PATTERN EMBODIMENT

| Dimple | Percent of Ball Diameter |
|---|---|
| A | 6.55 |
| B | 8.93 |
| C | 9.23 |
| D | 9.52 |
| E | 10.12 |

Figure 11:
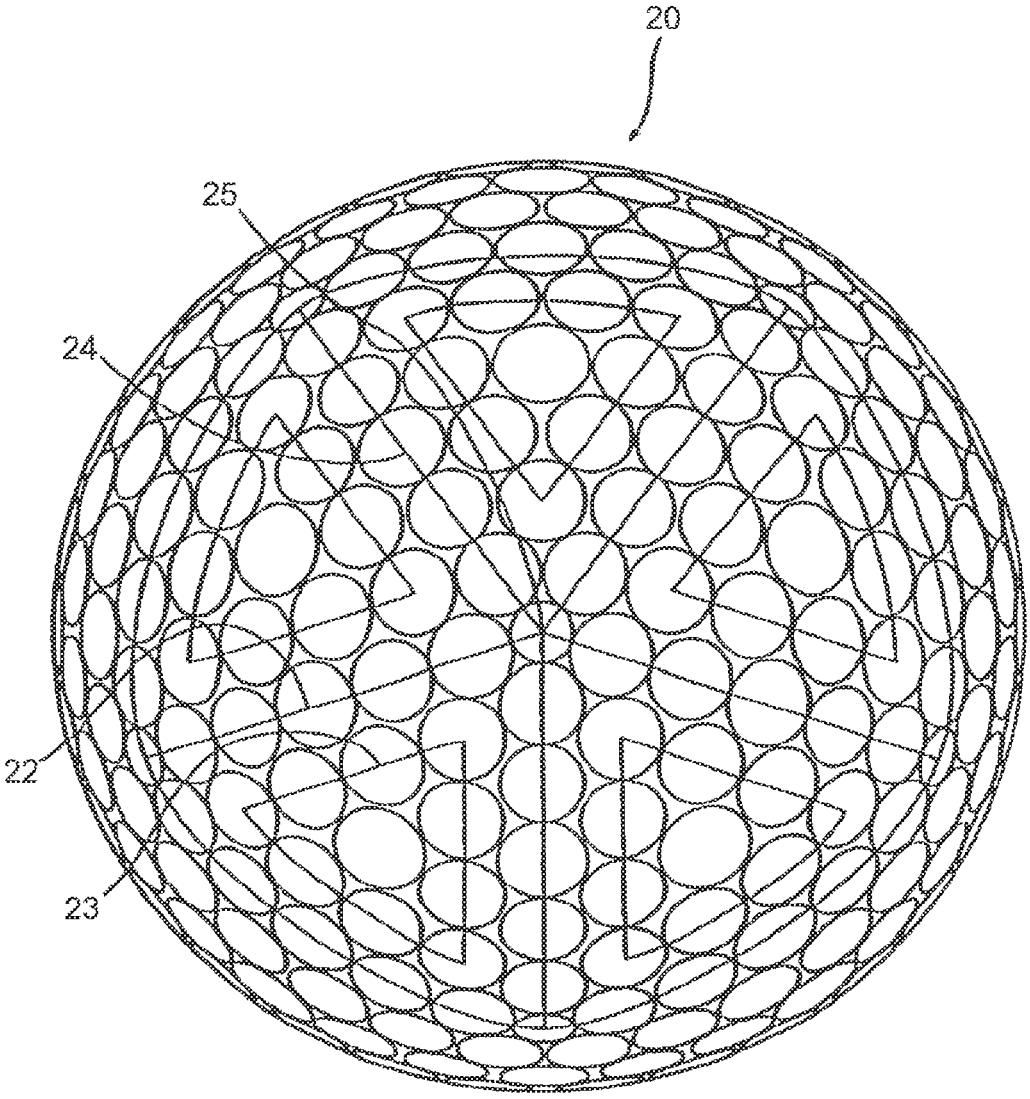
FIG. 11 is a top view of the golf ball in FIG. 9, showing dimple arrangement.
Figure 13:
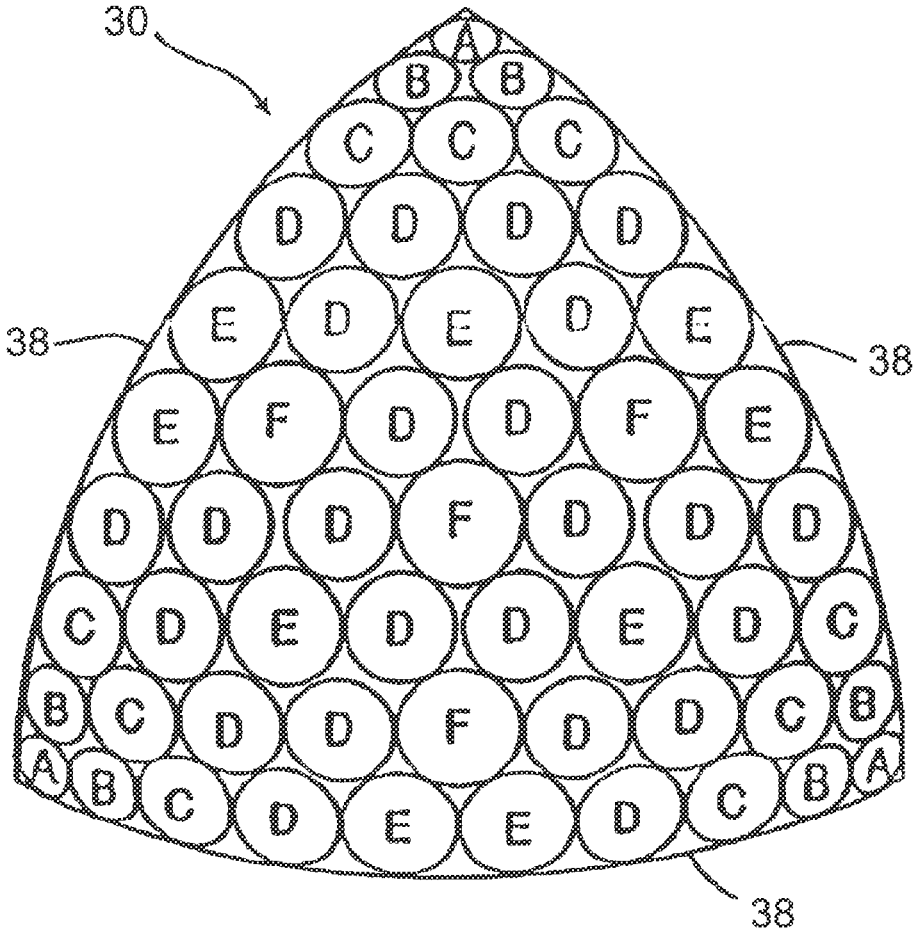
FIG. 13 is a spherical-triangular region of a golf ball according to the present invention having an octahedral dimple pattern, showing dimple sizes.
Figure 14:
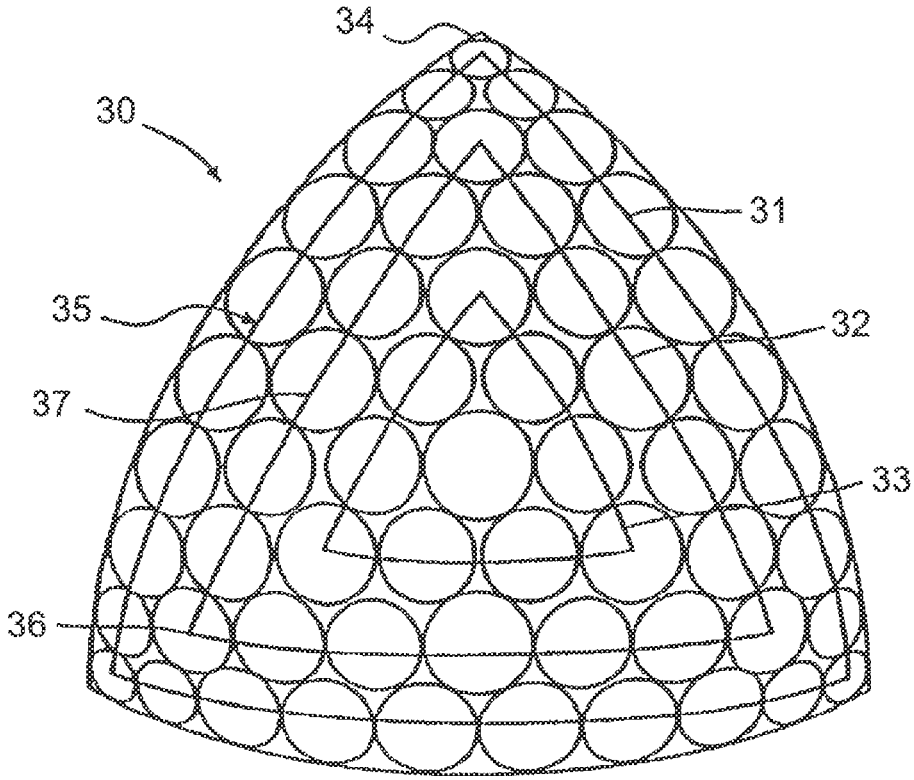
FIG. 14 is the spherical triangular region of FIG. 13, showing the triangular dimple arrangement.

In the second dimple pattern embodiment, the dimples are again formed in large triangles 22 and small triangles 23 as shown in FIG. 11. The dimples along the sides of the large triangle 22 increase in diameter toward the midpoint 24 of the sides. The largest dimple along the sides, $D_D$, is located at the midpoint 24 of each side of the large triangle 22, and the smallest dimples, $D_A$, are located at the triangle points 25. In this embodiment, each dimple along the sides is larger than the adjacent dimple toward the triangle point, i.e., $D_B>D_A$ and $D_D>D_B$ A third dimple pattern embodiment is illustrated in FIGS. 13-14, wherein the golf ball has an octahedral dimple pattern. In an octahedral dimple pattern, there are eight spherical triangular regions 30 that form the ball. In this third dimple pattern embodiment, there are six different sized dimples A-F, wherein dimples F ($D_F$) are greater than dimples E ($D_E$), which are greater than dimples D ($D_D$), which are greater than dimples C ($D_C$), which are greater than dimples B($D_B$), which are greater than dimples A ($D_A$); $D_F>D_E>D_D>D_C>D_B>D_A$. Dimple minimum sizes according to this embodiment are set forth in Table 9 below:

TABLE 9

DIMPLE SIZES FOR THIRD DIMPLE PATTERN EMBODIMENT

| Dimple | Percentage of Ball Diameter |
|---|---|
| A | 5.36 |
| B | 6.55 |
| C | 8.33 |
| D | 9.83 |
| E | 9.52 |
| F | 10.12 |

In this third dimple pattern embodiment, the dimples are formed in large triangles 31, small triangles 32 and smallest triangles 33. Each dimple along the sides of the large triangle 31 is equal to or larger than the adjacent dimple from the point 34 to the midpoint 35 of the triangle 31. The dimples at the midpoint 35 of the side, $D_E$, are the largest dimples along the side and the dimples at the points 34 of the triangle, $D_A$, are the smallest. In addition, each dimple along the sides of the small triangle 32 is also equal to or larger than the adjacent dimple from the point 36 to the midpoint 37 of the triangle 32. The dimple at the midpoint 37 of the side, $D_F$, is the largest dimple along the side and the dimples at the points 36 of the triangle, $D_C$, are the smallest.

Dimple Packaging

In one embodiment, the golf balls of the invention include an icosahedron dimple pattern, wherein each of the sides of the large triangles are formed from an odd number of dimples and each of the side of the small triangles are formed with an even number of dimples.

For example, in the icosahedron pattern shown in FIGS. 7-8 and 9-12, there are seven dimples along each of the sides of the large triangle 22 and four dimples along each of the sides of the small triangle 23. Thus, the large triangle 22 has nine more dimples than the small triangle 23, which creates hexagonal packing 26, i.e., each dimple is surrounded by six other dimples for most of the dimples on the ball. For example, the center dimple, $D_E$, is surrounded by six dimples slightly smaller, $D_D$. In one embodiment, at least 75 percent of the dimples have 6 adjacent dimples. In another embodiment, only the dimples forming the points of the large triangle 25, $D_A$, do not have hexagonal packing. Since $D_A$ are smaller than the adjacent dimples, the gaps between adjacent dimples is surprisingly small when compared to the prior art golf ball shown in FIG. 7.

The golf ball 20 has a greater dispersion of the largest dimples. For example, in FIG. 7, there are four of the largest diameter dimples, $D_E$, located in the center of the triangles and at the mid-points of the triangle sides. Thus, there are no two adjacent dimples of the largest diameter. This improves dimple packing and aerodynamic uniformity. Similarly, in FIG. 9, there is only one largest diameter dimple, $D_E$, which is located in the center of the triangles. Even the next to the largest dimples, $D_D$ are dispersed at the mid-points of the large triangles such that there are no two adjacent dimples of the two largest diameters, except where extra dimples have been added along the equator.

In the third dimple pattern embodiment, each of the sides of the large triangle 31 has an even number of dimples, each of the sides of the small triangle 32 has an odd number of dimples and each of the sides of the smallest triangle 33 has an even number of dimples. There are ten dimples along the sides of the large triangles 31, seven dimples along the sides of the small triangles 32, and four dimples along the sides of the smallest triangles 33. Thus, the large triangle 31 has nine more dimples than the small triangle 32 and the small triangle 32 has nine more dimples than the smallest triangle 33. This creates the hexagonal packing for all of the dimples inside of the large triangles 31.

As used herein, adjacent dimples can be considered as any two dimples where the two tangent lines from the first dimple that intersect the center of the second dimple do not intersect any other dimple. In one embodiment, less than 30 percent of the gaps between adjacent dimples is greater than 0.01 inches. In another embodiment, less than 15 percent of the gaps between adjacent dimples is greater than 0.01 inches.

One embodiment of the present invention contemplates dimple coverage of greater than about 80 percent. For example, the percentages of surface area covered by dimples in the embodiments shown in FIGS. 7-8 and 9-12 are about 85.7 percent and 82 percent, respectively whereas the ball shown in FIG. 5 has less than 80 percent of its surface covered by dimples. The percentage of surface area covered by dimples in the third embodiment shown in FIGS. 13-14 is also about 82 percent, whereas prior art octahedral balls have less than 77 percent of their surface covered by dimples, and most have less than 60 percent. Thus, there is a significant increase in surface area contemplated for the golf balls of the present invention as compared to prior art golf balls.

Parting Line

A parting line, or annular region, about the equator of a golf ball has been found to separate the flow profile of the air into two distinct halves while the golf ball is in flight and reduce the aerodynamic force associated with pressure recovery, thus improving flight distance and roll. The parting line must coincide with the axis of ball rotation. It is possible to manufacture a golf ball without parting line, however, most balls have one for ease of manufacturing, e.g., buffing of the golf balls after molding, and many players prefer to have a parting line to use as an alignment aid for putting.

In one embodiment of the present invention, the golf balls include a dimple pattern containing at least one parting line, or annular region. In another embodiment, there is no parting line that does not intersect any dimples, as illustrated in the golf ball shown in FIG. 7. While this increases the percentage of the outer surface that is covered by dimples, the lack of the parting line may make manufacturing more difficult.

Figure 12:
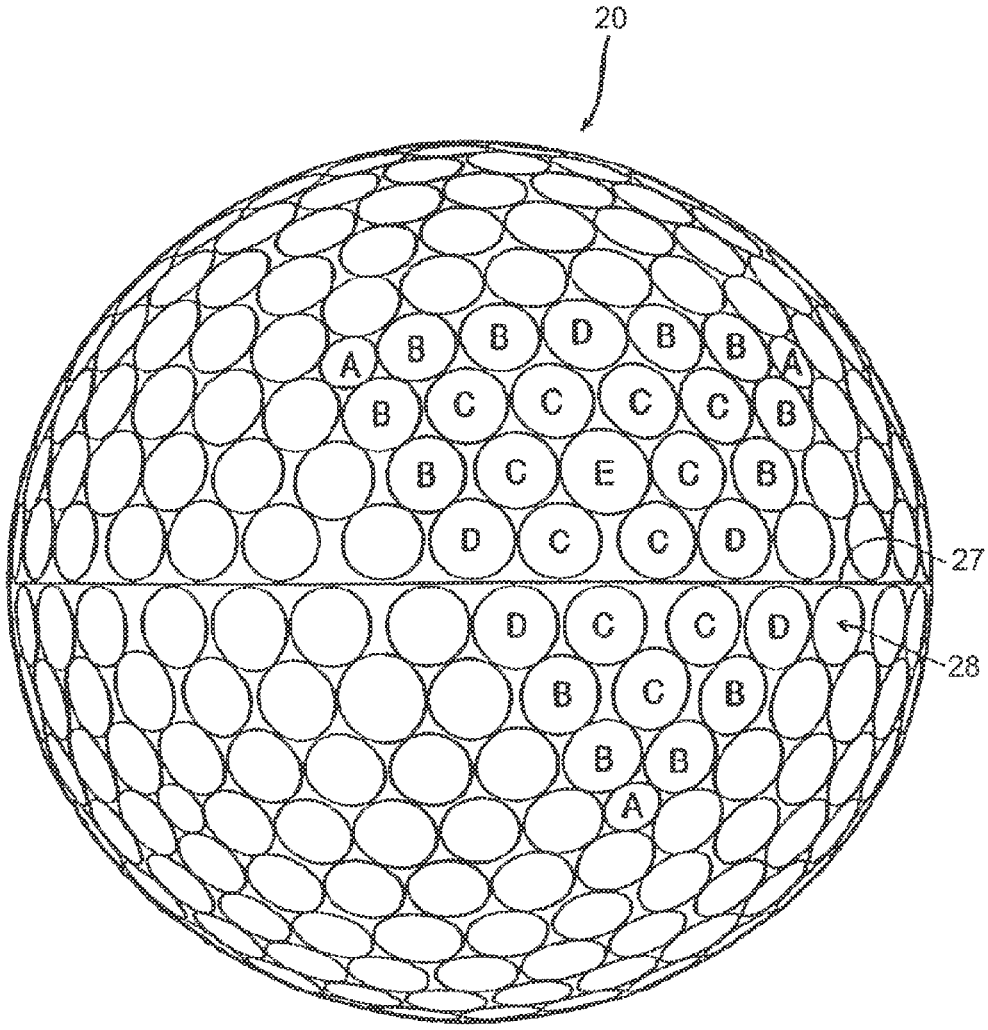
FIG. 12 is a side view of the golf ball in FIG. 9, showing the dimple arrangement at the equator.

In yet another embodiment, the parting line(s) may include regions of no dimples or regions of shallow dimples. For example, most icosahedron patterns generally have modified triangles around the mid-section to create a parting line that does not intersect any dimples. Referring specifically to FIG. 12, the golf ball in this embodiment has a modified icosahedron pattern to create the parting line 27, which is accomplished by inserting an extra row of dimples. In the triangular section identified with lettered dimples, there is an extra row 28 of D-C-C-D dimples added below the parting line 27. Thus, the modified icosahedron pattern in this embodiment has thirty more dimples than the unmodified icosahedron pattern in the embodiment shown in FIGS. 7-8.

In another embodiment, there are more than two parting lines that do not intersect any dimples. For example, the octahedral golf ball shown in FIGS. 13-14 contains three parting lines 38 that do not intersect any dimples. This decreases the percentage of the outer surface as compared to the first embodiment, but increases the symmetry of the dimple pattern.

In another embodiment, the golf balls according to the present invention may have the dimples arranged so that there are less than four parting lines that do not intersect any dimples.

Dimple Count

In one embodiment, the golf balls according to the present invention have about 300 to about 500 total dimples. In another embodiment, the dimple patterns are icosahedron patterns with about 350 to about 450 total dimples. For example, the golf ball of FIGS. 7-8 have 362 dimples. In the golf ball shown in FIGS. 9-12, there are 392 dimples and in the golf ball shown in FIGS. 13-14, there are 440 dimples.

Dimple Diameter

In one embodiment, at least about 80 percent of the dimples have a diameter of about 6.5 percent of the ball diameter or greater so that the majority of the dimples are sufficiently large to assist in creating the turbulent boundary layer. In another embodiment, at least about 90 percent of the dimples have a diameter of about 6.5 percent of the ball diameter or greater. In yet another embodiment, at least about 95 percent of the dimples have a diameter of about 6.5 percent of the ball diameter or greater. For example, all of the dimples have a diameter of about 6.5 percent of the ball diameter or greater in the ball illustrated by FIGS. 9-12.

Dimple Profile

Golf balls may also be designed to fit the aerodynamic criteria of Table 1 by creating dimple patterns wherein all dimples have fixed radii and depth, but vary as to shape. For example, dimple shape variations may be defined as edge radius and edge angle or by catenary shape factor and edge radius.

In one embodiment, a golf ball of the present invention meets the criteria of Table 1 by including dimples defined by the revolution of a catenary curve about an axis. A catenary curve represents the curve formed by a perfectly flexible, uniformly dense, and inextensible cable suspended from its endpoints. In general, the mathematical formula representing such a curve is expressed as Equation 11:

$$y=a\cos h(bx) \qquad \text{(Eq. 11)}$$

where a=constant b=constant y=vertical axis (on a two dimensional graph)

x=horizontal axis (on a two dimensional graph)

The dimple shape on the golf ball is generated by revolving the catenary curve about its y axis.

This embodiment uses variations of Equation 11 to define the cross-section of golf ball dimples. For example, the catenary curve is defined by hyperbolic sine or cosine functions.

A hyperbolic sine function is expressed as Equation 12 below:

$$\sin h(x)=(e^{x}-e^{-x})/2 \quad \text{(Eq. 12)}$$

while a hyperbolic cosine function is expressed by Equation 13:

$$\cos h(x)=(e^{x}+e^{-x})/2 \quad \text{(Eq. 13)}$$

In one embodiment, the mathematical equation for describing the cross-sectional profile of a dimple is expressed by Equation 14:

$$Y=(d(\cos h(ax)-1))/(\cos h(ar)-1) \quad \text{(Eq. 14)}$$

where

Y=vertical distance from the dimple apex x=radial distance from the dimple apex to the dimple surface a=shape constant (shape factor)

d=depth of dimple r=radius of dimple

The "shape constant" or "shape factor", a, is an independent variable in the mathematical expression for a catenary curve. The shape factor may be used to independently alter the volume ratio of the dimple while holding the dimple depth and radius fixed. The volume ratio is the fractional ratio of the dimple volume divided by the volume of a cylinder defined by a similar radius and depth as the dimple.

Use of the shape factor provides an expedient method of generating alternative dimple profiles, for dimples with fixed radii and depth. For example, to design a golf ball with lift and drag characteristics to fit the aerodynamic criteria of Table 1, alternative shape factors may be employed to obtain alternative lift and drag performance without having to change dimple pattern, depth or size. No modification to the dimple layout on the surface of the ball is required.

Figure 15:
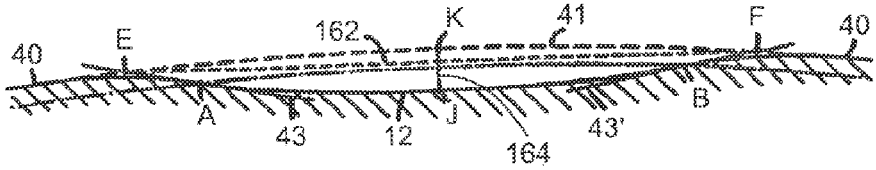
FIG. 15 shows a method for measuring the depth and radius of a dimple.
Figure 16:
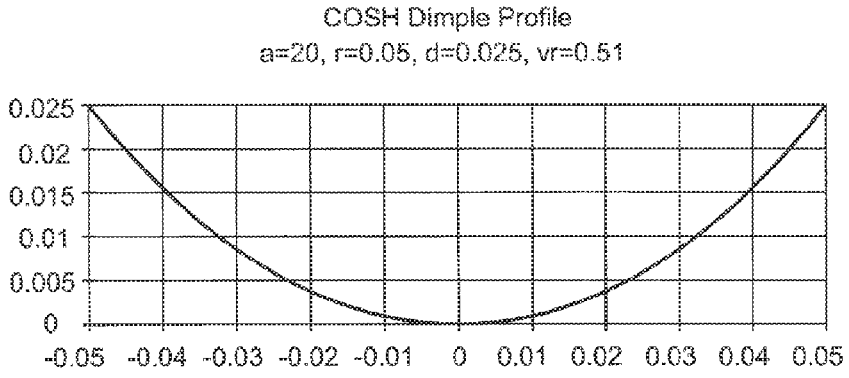
FIG. 16 is a dimple cross-sectional profile defined by a hyperbolic cosine function, cos h, with a shape constant of 20, a dimple depth of 0.025 inches, a dimple radius of 0.05 inches, and a volume ratio of 0.51.
Figure 17:
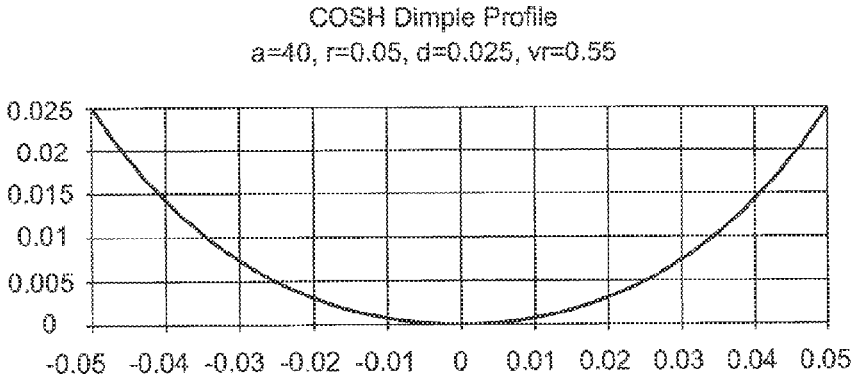
FIG. 17 is a dimple cross-sectional profile defined by a hyperbolic cosine function, cos h, with a shape constant of 40, a dimple depth of 0.025 inches, a dimple radius of 0.05 inches, and a volume ratio of 0.55.
Figure 18:
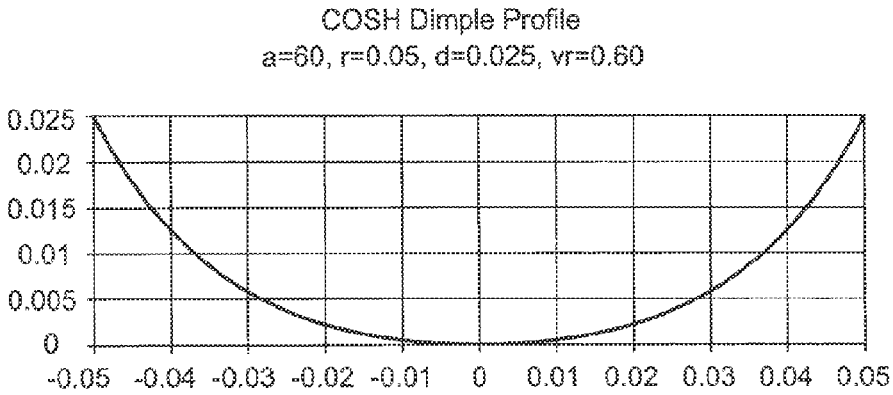
FIG. 18 is a dimple cross-sectional profile defined by a hyperbolic cosine function, cos h, with a shape constant of 60, a dimple depth of 0.025 inches, a dimple radius of 0.05 inches, and a volume ratio of 0.60.
Figure 19:
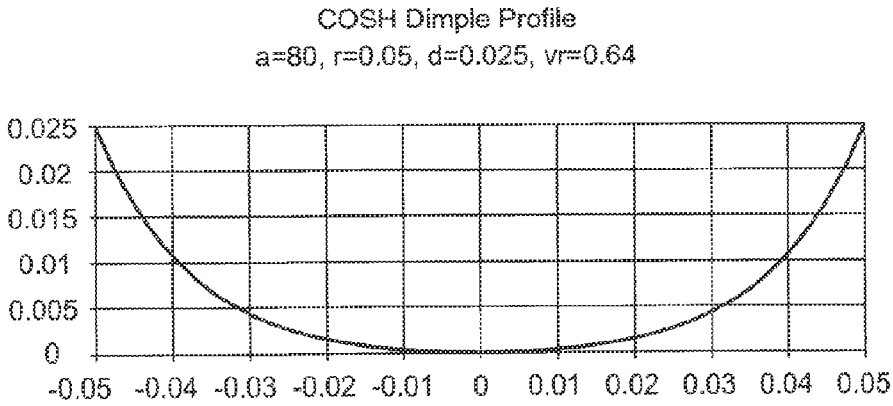
FIG. 19 is a dimple cross-sectional profile defined by a hyperbolic cosine function, cos h, with a shape constant of 80, a dimple depth of 0.025 inches, a dimple radius of 0.05 inches, and a volume ratio of 0.64.
Figure 20:
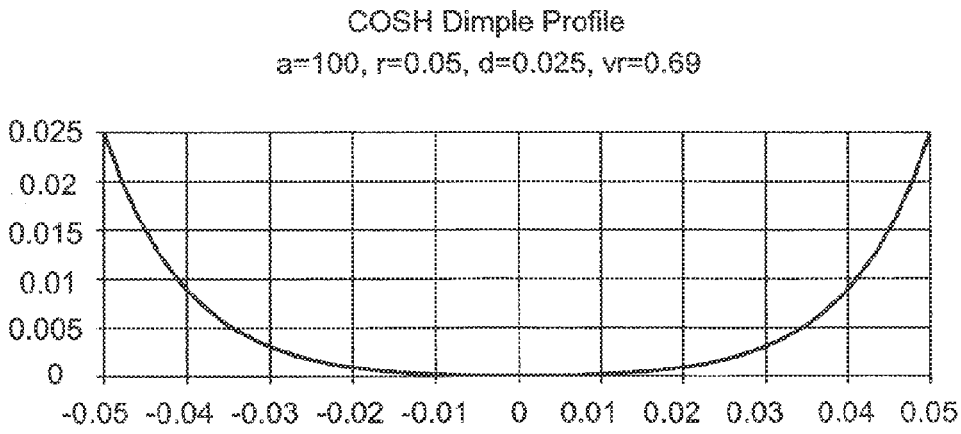
FIG. 20 is a dimple cross-sectional profile defined by a hyperbolic cosine function, cos h, with a shape constant of 100, a dimple depth of 0.025 inches, a dimple radius of 0.05 inches, and a volume ratio of 0.69.

The depth (d) and radius (r) (r=½D) of the dimple may be measured as described in U.S. Pat. No. 4,729,861 (shown in FIG. 15), the disclosure of which is incorporated by reference in its entirety. The dimple diameter is measured from the edges of the dimples, points E and F, along straight line 162. Point J is the deepest part of the dimple 12. The depth is measured from point K on the continuation of the periphery 41 to point J and is indicated by line 164. Line 164 is perpendicular to line 162.

For Equation 14, shape constant values that are larger than 1 result in dimple volume ratios greater than 0.5. In one embodiment, shape factors are between about 20 to about 100. FIGS. 16-20 illustrate dimple profiles for shape factors of 20, 40, 60, 80, and 100, respectively. Table 10 illustrates how the volume ratio changes for a dimple with a radius of 0.05 inches and a depth of 0.025 inches. Increases in shape factor result in higher volume ratios for a given dimple radius and depth. It has been discovered that the use of dimples with multiple catenary shape factors may be used to obtain the aerodynamic criteria of Table 1 and the symmetry requirements of less than 6 percent variation $C_{mag}$.

TABLE 10

VOLUME RATIO AS A FUNCTION OF RADIUS AND DEPTH

| SHAPE FACTOR | VOLUME RATIO |
|---|---|
| 20 | 0.51 |
| 40 | 0.55 |
| 60 | 0.60 |

TABLE 10-continued

VOLUME RATIO AS A FUNCTION OF RADIUS AND DEPTH

| SHAPE FACTOR | VOLUME RATIO |
|---|---|
| 80 | 0.64 |
| 100 | 0.69 |

A dimple whose profile is defined by the cos h catenary curve with a shape constant of less than about 40 will have a smaller dimple volume than a dimple with a spherical profile. This will result in a larger aerodynamic force angle and higher trajectory. On the other hand, a dimple whose profile is defined by the cos h catenary curve with a shape constant of greater than about 40 will have a larger dimple volume than a dimple with a spherical profile. This will result in a smaller angle of the aerodynamic force and a lower trajectory. Therefore, a golf ball having dimples defined by a catenary curve with a shape constant is advantageous because the shape constant may be selected to obtain the aerodynamic criteria delineated in Table 1.

While this embodiment is directed toward using a catenary curve for at least one dimple on a golf ball, it is not necessary that catenary curves be used on every dimple on a golf ball. In some cases, the use of a catenary curve may only be used for a small number of dimples. It is preferred, however, that a sufficient number of dimples on the ball have catenary curves so that variation of shape factors will allow a designer to alter the aerodynamic characteristics of the ball to satisfy the aerodynamic criteria of Table 1. In one embodiment, the golf ball has at least about 10 percent, and more preferably at least about 60 percent, of its dimples defined by a catenary curves.

Moreover, it is not necessary that every dimple have the same shape factor. Instead, differing combinations of shape factors for different dimples on the ball may be used to achieve desired ball flight performance. For example, some of the dimples defined by catenary curves on a golf ball may have one shape factor while others have a different shape factor. In addition, the use of differing shape factors may be used for different diameter dimples, as described above in FIGS. 6-14.

Therefore, once a dimple pattern is selected for the golf ball, alternative shape factors for the catenary profile can be tested in light gate test range, as described in U.S. Pat. No. 6,186,002, to empirically determine the catenary shape factor that provides the desired aerodynamic characteristics of Table 1.

Aerodynamic Symmetry

To create a ball that adheres to the Rules of Golf, as approved by the United States Golf Association, the ball must not be designed, manufactured or intentionally modified to have properties that differ from those of a spherically symmetrical ball. Aerodynamic symmetry allows the ball to fly with little variation no matter how the golf ball is placed on the tee or ground.

Figure 21:
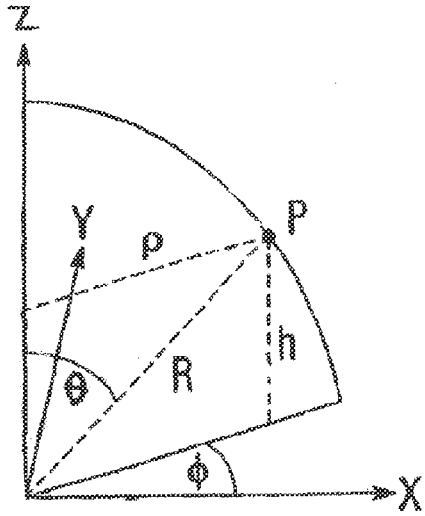
FIG. 21 is a graph illustrating the coordinate system in a dimple pattern according to one embodiment of the invention.

Dimple patterns are preferably designed to cover the maximum surface area of the golf ball without detrimentally affecting the aerodynamic symmetry of the golf ball. A representative coordinate system used to model some of the dimple patterns discussed above is shown in FIG. 21. The XY plane is the equator of the ball while the Z direction goes through the pole of the ball. Preferably, the dimple pattern is generated from the equator of the golf ball, the XY plane, to the pole of the golf ball, the Z direction.

As discussed above, golf balls containing dimple patterns having a parting line about the equator may result in orientation specific flight characteristics. As mentioned above, the parting lines are desired by manufacturers for ease of production, as well as by many golfers for lining up a shot for putting or off the tee. It has now been discovered that selective design of golf balls with dimple patterns including a parting line meeting the aerodynamic criteria set forth in Table 1 result in flight distances far improved over prior art. Geometrically, these parting lines must be orthogonal with the axis of rotation. However, in one embodiment of the present invention, there may be a plurality of parting lines with multiple orientations.

In one embodiment, the aerodynamic coefficient magnitude for a golf ball varies less than about 6 percent whether a golf ball has a PH or PP orientation. In another embodiment, the variation of the aerodynamic coefficient magnitude between the two orientations is less than about 3 percent.

Ball Construction

Various embodiments of the present invention may be practiced using a suitable ball construction as would be apparent to one of ordinary skill in the art. For example, the ball may have a 1-piece design, a 2-piece design, a three-piece design, a double core, a double cover, or multi-core and multi-cover construction depending on the type of performance desired of the ball. Non-limiting examples of these and other types of ball constructions that may be used with the present invention include those described in U.S. Pat. Nos. 5,688,191, 5,713,801, 5,803,831, 5,885,172, 5,919,100, 5,965,669, 5,981,654, 5,981,658, and 6,149,535, as well as in U.S. Patent Application Publication No. US2001/0009310 A1. The entire disclosures of these patents and published application are incorporated by reference herein.

Figure 25:
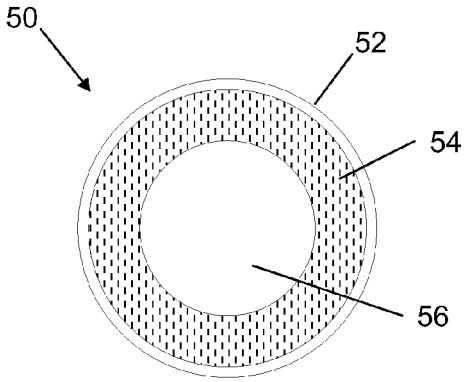
FIG. 25 shows a cross-section of a golf ball having an intermediate layer comprising a viscous fluid.

In one embodiment of the present invention, a solid/liquid construction golf ball having a high spin decay rate as described above comprises a solid core decoupled from an outer cover or core layer(s) by an intermediate layer comprised of at least a viscous material. The separation of the solid cover from the core by the intermediate layer allows the cover to spin relative to the core, thereby contributing to a higher rate of spin decay in the initial moments of flight. The flowing, viscous layer between the core and the outer layer(s) or cover then siphons off a portion of the rotational energy imparted on the ball after impact by a club, thereby reducing the rate of spin of the ball. In an example of the present invention as shown in FIG. 25, a ball 50 comprises a solid core 56 surrounded by an intermediate layer 54 comprising a viscous fluid and at least a solid outer cover 52. Solid cover 52 should be sufficiently thick to withstand repeated impacts with a golf club without cracking, chipping, or otherwise becoming damaged. Preferably, intermediate layer 54 comprises a high-viscosity fluid. The fluid preferably has a viscosity of about 1000 centipoise (cP) to about 250,000 cP. More preferably, the viscosity is greater than about 10,000 cP, greater than about 50,000 cP, or greater than about 100,000 cP.

An intermediate fluid layer with high viscosity will resist the movement of a particle resting therein, i.e., the core. As the movement of the core is limited by the medium that surrounds it, the core is more likely to remain in position at the center of the ball thus contributing to the stability of the golf ball during flight. An intermediate fluid layer having high viscosity also allows for the inclusion of a core with higher relative density, which is useful in golf balls with low moment of inertia and controlled spin rates, or a core with low relative density, which is useful for golf balls with higher moment of inertia. Because a high viscosity intermediate fluid layer resists movement by the core, it will minimize the movement of a core with higher or lower specific gravity from sinking or moving from a position other than the center of the ball. The fluid layer can be composed of a variety of materials, including but not limited to glycerine, oils, water solutions, and gels, such as gelatin gels, hydrogels, water/methyl cellulose gels and gels comprised of copolymer rubber based materials such a styrene-butadiene-styrene rubber and paraffinic and/or naphthenic oil. Commonly-owned U.S. Pat. No. 6,797,097 discusses materials that may be used to construct a fluid portion of a golf ball and is incorporated by reference herein in its entirety.

To optimize the spin-decay properties of the intermediate fluid layer of a golf ball of the present invention, the volume, specific gravity, and viscosity of the material comprising the fluid layer should be determined so that changes in spin decay among golf balls of different compositions are incremental and selective. Fluids generally become less viscous when heated, although some fluids exhibit greater viscosity as temperature rises. Materials comprising the intermediate fluid layer described above should exhibit optimum viscosity at a temperature range that correlates generally to the range in which most golfers play, i.e. between about 40° F. to about 120° F.

The intermediate layer may also be composed materials, such as viscoelastic liquid, that exhibit characteristics of both fluids (i.e. under long-duration stress it flows like a viscous liquid) and solids (i.e. under short-term stress it exhibits elasticity). Commonly-owned published U.S. Patent Application Publication No. US2005/0227786 discusses these materials and is incorporated herein by reference in its entirety. In a golf ball of the present invention having an intermediate layer composed of viscoelastic liquid, a fraction of the force imparted by a golf club on the golf ball is converted into heat, thereby reducing the amount of mechanical energy available to the ball to maintain a high rate of backspin. Also, it is expected that at or immediately after impact, the viscoelastic liquid acts like an elastic solid, and thereafter, when only small forces are acting on the ball, the viscoelastic liquid acts like a viscous fluid to slow done the spin rate. Suitable materials for use in golf balls are disclosed in the '786 application and include but are not limited to polyether-based polyurethane and polyurea. An example of a suitable viscoelastic liquid is polydimethylsiloxane (PDMS).

In accordance with another aspect of the present invention, the specific gravity of an intermediate viscous fluid layer is substantially equal to the specific gravity of the core, allowing the core to remain in suspension at the center of the golf ball. Preferably, the specific gravities of the viscous fluid layer and the core are within about 3% of each other, more preferably within about 2% of each other, and most preferably within about 1% of each other. Upon impact between a golf club and a golf ball of the present invention, the core may shift position within the core-intermediate fluid layer subassembly; however, due to similar specific gravities, the core-intermediate fluid assembly is balanced and should not affect the flight trajectory of the ball. This type of construction also allows for the use of less viscous materials in the intermediate fluid layer, as the core will not tend to sink and float in the material of the intermediate layer.

Figure 26:
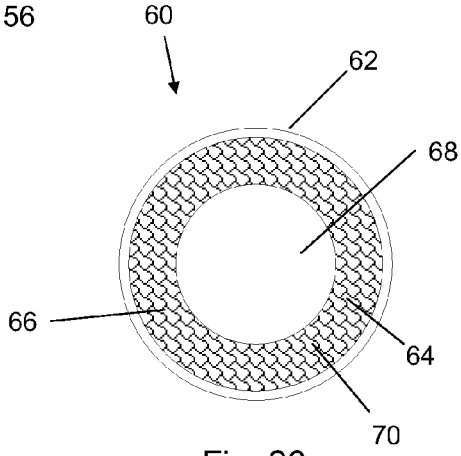
FIG. 26 shows a cross-section of a golf ball having an intermediate layer comprising a foamed polymeric material and a viscous fluid.

In another example of the present invention as shown in FIG. 26, a solid construction golf ball 60 comprises a solid core 68, an intermediate layer 66 comprising a viscous fluid 70 and a structural support material 64, and at least a solid outer cover 62. In accordance with the present invention, intermediate layer 66 includes a viscous fluid to optimize spin decay and a structural support material for the core. In this construction, structural support 64 can couple core 68 to cover 62, allowing core 68 and cover 62 to spin at a substantially similar rate. As in the previous example, the fluid can be a variety of materials, such as glycerine, oils, water solutions, and gels. The materials disclosed for use in the fluid component of golf balls in the previously mentioned '097 patent may also be used. Structural support material 64 of intermediate layer 66 can be composed of an open-cell foam, either reticulated or nonreticulated.

Open-cell foams can have both open and closed cell membranes, allowing fluid to flow between cells. When used in the intermediate layer of an optimized spin-decay golf ball, an open-cell foam permits the flow of fluid between cell membranes and around the layer, thereby absorbing a portion of the rotational energy of the golf ball and effectively damping the rate of spin of the golf ball. Suitable open-cell foams should have a porosity between about 30% and about 70%, and a permeability of at least 50% of the flow rate of the viscous fluid when the open-cell foam is omitted. The open-cell foam can be comprised of polyester, polyether urethane, polyimide, melamine, or other materials. Further, the foam can be molded prior to introduction to the golf ball, or it can be produced by combining foam reactants in situ, as disclosed in commonly-owned U.S. Pat. No. 7,160,954, which is incorporated herein by reference in its entirety. The in situ method proscribes that a polymer blend be combined with a foaming or blowing agent during molding, causing the polymeric material to expand and assume a cellular composition. Suitable foaming materials are discussed in U.S. Pat. No. 4,274,637 and include polyethylene, polyurethanes and ionic copolymers of olefins. Useful blowing agents include, but are not limited to, azobisformamide; azobisisobutyronitrile; diazoaminobenzene; N, N-dimethyl-N, N-dinitroso terephthalamide; N, N-dinitrosopentamethylene-tetramine; benzenesulfonyl-hydrazide; benzene-1, 3-disulfonyl hydrazide; diphenylsulfon-3-3, disulfonyl hydrazide; 4,4'-oxybis benzene sulfonyl hydrazide; p-toluene sulfonyl semicarbazide; barium azodicarboxylate; butylamine nitrile; nitroureas; trihydrazino triazine; phenylmethyl-uranthan p-sulfonhydrazide; and inorganic blowing agents such as ammonium bicarbonate and sodium bicarbonate. Gases, including air, nitrogen, carbon-dioxide and others may also be introduced to the polymer during injection molding to foam the composition.

Figure 27:
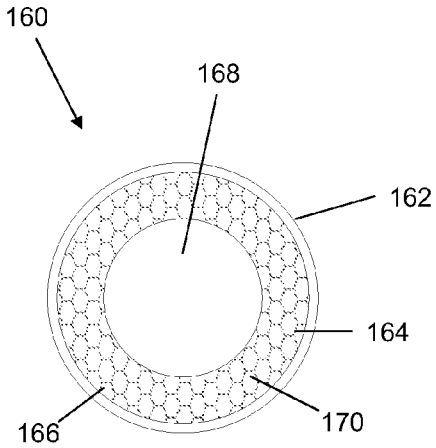
FIG. 27 shows a cross-section of a golf ball having an intermediate layer comprising a polymeric honeycomb material and a viscous fluid.

The structural material of the intermediate layer of the previous example can also be comprised of an open-cell honeycomb structure. FIG. 27 shows a golf ball 160 of the present invention with an intermediate layer 166 comprising a viscous fluid 170 and a honeycomb structure 164. Golf ball 160 also comprises a solid core 168 and an outer cover 162. The material comprising the honeycomb structure can in include, but is not limited to, thermoplastics such as polycarbonate and polypropylene. Thermoplastic honeycombs are generally manufactured through a process of heating thermoplastic polymeric material between mold platens to bond the polymeric material to the mold platens. The mold platens, which typically have a perforated surface, are then separated to expand the polymeric material and impart it with a cross-sectional honeycomb geometry. This type of honeycomb material is preferable because it can be stretched and curved during manufacturing. In accordance with an aspect the present invention, thermoplastic honeycomb material comprising an intermediate layer of the golf ball should maintain rigidity up to temperatures of at least 120° F.

While it is apparent that the illustrative embodiments of the invention herein disclosed fulfill the objectives stated above, it will be appreciated that numerous modifications and other embodiments such as tetrahedrons having four triangles may be devised by those skilled in the art. Therefore, it will be understood that the appended claims are intended to cover all such modifications and embodiments which come within the spirit and scope of the present invention.

What is claimed is:

1. A golf ball comprising a solid core, a solid cover and an intermediate layer disposed therebetween, wherein the intermediate layer comprises a fluid and a honeycomb material, such that after being impacted by a golf club the rate of spin decay is greater than 4% during the first second after impact.

2. The golf ball of claim 1, wherein the honeycomb material comprises polycarbonate.

3. The golf ball of claim 1, wherein the honeycomb material comprises polypropylene.

4. The golf ball of claim 1, wherein the intermediate layer decouples the solid core from the solid cover.

5. The golf ball of claim 1, wherein the fluid has a viscosity of from about 1,000 to about 250,000 centipoises.

6. The golf ball of claim 1, wherein the intermediate layer comprises a viscoelastic liquid.

7. A golf ball comprising a solid core, a solid cover and an intermediate layer disposed therebetween, wherein the intermediate layer comprises a fluid and a honeycomb material, wherein the fluid has a viscosity of from about 1,000 to about 250,000 centipoises.

8. The golf ball of claim 7, wherein the honeycomb material comprises polycarbonate.

9. The golf ball of claim 7, wherein the honeycomb material comprises polypropylene.

10. The golf ball of claim 7, wherein the fluid has a viscosity of from about 10,000 to about 250,000 centipoises.

11. The golf ball of claim 7, wherein the fluid has a viscosity of from about 50,000 to about 250,000 centipoises.

12. The golf ball of claim 7, wherein the fluid has a viscosity of from about 100,000 to about 250,000 centipoises.

13. A golf ball comprising a solid core, a solid cover and an intermediate layer disposed therebetween, wherein the intermediate layer comprises a viscous fluid and a honeycomb material, wherein the specific gravities of the viscous fluid and the core are within about 3% of each other.

14. The golf ball of claim 13, wherein the honeycomb material comprises polycarbonate.

15. The golf ball of claim 13, wherein the honeycomb material comprises polypropylene.

16. The golf ball of claim 13, wherein the specific gravities of the viscous fluid and the core are within about 2% of each other.

17. The golf ball of claim 13, wherein the specific gravities of the viscous fluid and the core are within about 1% of each other.

* * * * *